US012649560B1

(12) United States Patent
Farrell et al.

(10) Patent No.: US 12,649,560 B1
(45) Date of Patent: Jun. 9, 2026

(54) WAKE BOATS HAVING BATTERY SYSTEMS AND ELECTRIC PROPULSION DEVICES FOR WAKE BOATS

(71) Applicant: Brunswick Corporation, Mettawa, IL (US)

(72) Inventors: Kevin T. Farrell, Port Orange, FL (US); Clint E. Szumal, Ormond Beach, FL (US)

(73) Assignee: Brunswick Corporation, Mettawa, IL (US)

( * ) Notice: Subject to any disclaimer, the term of this patent is extended or adjusted under 35 U.S.C. 154(b) by 385 days.

(21) Appl. No.: 18/454,255

(22) Filed: Aug. 23, 2023

Related U.S. Application Data

(60) Provisional application No. 63/424,618, filed on Nov. 11, 2022.

(51) Int. Cl.
*B63H 21/17* (2006.01)
*B63B 34/70* (2020.01)
*B63H 23/32* (2006.01)

(52) U.S. Cl.
CPC ..... *B63H 21/17* (2013.01); *B63B 34/70* (2020.02); *B63H 23/321* (2013.01); *B63H 2023/325* (2013.01)

(58) Field of Classification Search
CPC ..... B63B 34/70
See application file for complete search history.

(56) References Cited

U.S. PATENT DOCUMENTS 3,236,202 A 2/1966 Quady et al.
4,217,845 A * 8/1980 Hood ..... B63B 43/06 114/39.21

(Continued)

FOREIGN PATENT DOCUMENTS

CN 106800082 6/2017
CN 206598971 10/2017

(Continued)

OTHER PUBLICATIONS

Inventor's Declaration of Prior Art. Signed by both Inventors on Sep. 27, 2023.

(Continued)

*Primary Examiner* — Magdalena Topolski
*Assistant Examiner* — Shanna Danielle Glover
(74) *Attorney, Agent, or Firm* — Andrus Intellectual Property Law, LLP

(57) ABSTRACT

A marine vessel has a hull, an electric motor configured to operate a propulsor for generating a propulsive force for propelling the marine vessel in water, port and starboard rear ballast cavities being configured to take on ballast water for modifying a wake produced by the marine vessel in the water, and port and starboard battery banks which provide battery power to the electric motor. The port and starboard battery banks are located above the port and starboard rear ballast cavities, respectively. A driveshaft assembly comprises a driveshaft which is caused to rotate by operation of the electric motor and an oil-filled driveshaft housing on the driveshaft. A propulsor mounted on the driveshaft generates a propulsive force in the water. A method of installing the port and starboard battery banks into the marine vessel is also provided.

18 Claims, 21 Drawing Sheets

(56) References Cited

U.S. PATENT DOCUMENTS

| | | | | |
|---|---|---|---|---|
| 4,811,680 | A * | 3/1989 | Genth | B63B 19/14 114/211 |
| 5,595,133 | A | 1/1997 | Bullard | |
| 6,234,099 | B1 * | 5/2001 | Jessen | B63B 34/60 114/121 |
| 6,257,165 | B1 | 7/2001 | Danos, Jr. et al. | |
| 6,273,015 | B1 * | 8/2001 | Motsenbocker | B63B 1/14 114/61.12 |
| 7,182,033 | B1 | 2/2007 | Phillips et al. | |
| 7,185,599 | B1 | 3/2007 | Griffiths et al. | |
| 7,263,945 | B2 * | 9/2007 | Little | B63B 35/34 114/61.1 |
| 7,533,622 | B1 | 5/2009 | Jaszewski et al. | |
| 7,806,065 | B1 | 10/2010 | Bekker et al. | |
| 8,123,577 | B2 | 2/2012 | Riggs | |
| 8,814,616 | B2 | 8/2014 | Riggs | |
| 9,108,710 | B1 | 8/2015 | McChesney et al. | |
| 9,919,784 | B1 | 3/2018 | Fisher | |
| 10,407,131 | B1 | 9/2019 | Ward | |
| 10,953,955 | B1 | 3/2021 | Fieldhouse et al. | |
| 11,091,234 | B1 | 8/2021 | Rose et al. | |
| 11,167,832 | B2 | 11/2021 | Doremus et al. | |
| 11,312,450 | B1 | 4/2022 | Rose et al. | |
| 11,572,146 | B2 | 2/2023 | Kraus et al. | |
| 11,591,057 | B2 | 2/2023 | Tornbaum et al. | |
| 11,643,176 | B1 | 5/2023 | Mueller et al. | |
| 11,691,707 | B1 | 7/2023 | Radavich et al. | |
| 2003/0006341 | A1 * | 1/2003 | Buder | B64G 1/6425 244/118.1 |
| 2006/0191457 | A1 * | 8/2006 | Murphy | B63B 23/00 114/253 |
| 2006/0228959 | A1 | 10/2006 | Ruiz | |
| 2008/0190227 | A1 | 8/2008 | Myers et al. | |
| 2012/0097086 | A1 | 4/2012 | Sancoff | |
| 2014/0158037 | A1 | 6/2014 | George | |
| 2015/0201548 | A1 | 7/2015 | Wolter et al. | |
| 2015/0259033 | A1 | 9/2015 | George et al. | |
| 2017/0203823 | A1 | 7/2017 | Abney | |
| 2019/0217921 | A1 | 7/2019 | Shibayama et al. | |
| 2021/0354803 | A1 | 11/2021 | Christensen et al. | |
| 2021/0380210 | A1 | 12/2021 | Fishburn et al. | |
| 2022/0089258 | A1 * | 3/2022 | Uggeri | B63B 34/75 |
| 2022/0328893 | A1 | 10/2022 | Oenick et al. | |
| 2022/0328912 | A1 | 10/2022 | Gonring | |
| 2023/0249795 | A1 | 8/2023 | Breyer | |

FOREIGN PATENT DOCUMENTS

| | | | | |
|---|---|---|---|---|
| DE | 102017000263 | A1 * | 7/2017 | H01M 50/231 |
| GB | 2554045 | A | 3/2018 | |
| JP | 2011016388 | | 1/2011 | |

OTHER PUBLICATIONS

Taylor et al., "Connectors for Electric Marine Devices," Unpublished U.S. Appl. No. 18/054,812, filed Nov. 11, 2022 (specification, claims, and drawings only).

Tornbaum, Andres Perdomo, "Methods for a Marine Vessel with Primary and Auxiliary Propulsion Devices," Unpublished U.S. Appl. No. 16/984,617, filed Aug. 4, 2020 (specification, claims, and drawings only).

Powerboat Television, "How to make docking a pontoon boat easy with a retractable SideShift Thruster | My Boat DIY", YouTube video, Jun. 1, 2020, available at https://www.youtube.com/watch?v=2NBx-Vnl3Kk.

Sideshift Inc., "Sideshift Dock Like a Pro PT230/PT360 Pontoon Thruster System," Installation/Operation Manual, Oct. 2019, vol. 2.4.

EV Reporter, "Skateboard Platform for Electric Vehicles", web article, Sep. 21, 2022, https://evreporter.com/about-skateboard-platform-for-electric-vehicles/#:~:text=A%20skateboard%20is%20a%20type,fundamental%20to%20an%20electric%20vehicle, accessed Jun. 20, 2023.

Groeschel et al., "Systems and Methods for Mounting Electric Stern Drives," Unpublished U.S. Appl. No. 18/076,836, filed Dec. 7, 2022 (specification, claims, and drawings only).

Belter et al., "Electric Stern Drives," Unpublished U.S. Appl. No. 18/097,327, filed Jan. 16, 2023 (specification, claims, and drawings only).

Waisanen et al., "Stern Drives and Methods of Installing Stern Drives," Unpublished U.S. Appl. No. 18/119,604, filed Mar. 9, 2023 (specification, claims, and drawings only).

Fergus et al., "Stern Drives Having Steerable Gearcase," Unpublished U.S. Appl. No. 18/120,507, filed Mar. 13, 2023 (specification, claims, and drawings only).

Groeschel et al., "Stern Drives and Transom Bracket Assemblies for Stern Drives Providing Vibration Isolation," Unpublished U.S. Appl. No. 18/123,468, filed Mar. 20, 2023 (specification, claims, and drawings only).

Hercules Electric Marine, "Hercules Marine—Electric Boat, Electric Marine Drive," webpage, https://hercules-marine.com, 11 pages, accessed Apr. 27, 2022.

Przybyl et al., "Outboard Marine Drives Having Supporting Frame and Cowling," Unpublished U.S. Appl. No. 17/984,440, filed Nov. 10, 2022 (specification, claims, and drawings only).

* cited by examiner

WAKE BOATS HAVING BATTERY SYSTEMS AND ELECTRIC PROPULSION DEVICES FOR WAKE BOATS

CROSS-REFERENCE TO RELATED APPLICATION

The present application claims the benefit of U.S. Provisional Application Ser. No. 63/424,618, filed Nov. 11, 2022, which is incorporated herein by reference in its entirety.

FIELD

The present disclosure relates to marine vessels and particularly to wake boats and to electric propulsion systems for wake boats.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

In non-limiting embodiments disclosed herein, a marine vessel has a hull, an electric motor configured to operate a propulsor for generating a propulsive force for propelling the marine vessel in water, port and starboard rear ballast cavities being configured to take on ballast water for modifying a wake produced by the marine vessel in the water, and port and starboard battery banks which provide battery power to the electric motor. The port and starboard battery banks may be located above the port and starboard rear ballast cavities, respectively.

In other or the same embodiments, a driveshaft assembly comprises a driveshaft which is caused to rotate by operation of the electric motor and an oil-filled driveshaft housing on the driveshaft. A propulsor mounted on the driveshaft generates a propulsive force in the water. A method of installing the port and starboard battery banks into the marine vessel is also provided.

In non-limiting embodiments, a marine vessel has a hull extending from a stern to a bow in a longitudinal direction, from a port side to a starboard side in a lateral direction which is perpendicular to the longitudinal direction, and from a top to a bottom in an axial direction which is perpendicular to the longitudinal direction and perpendicular to the axial direction. An electric motor is configured to operate a propulsor for generating a propulsive force for propelling the marine vessel in water. Port and starboard rear ballast cavities are configured to take on ballast water for modifying a wake produced by the marine vessel in the water. Port and starboard battery banks provide battery power to the electric motor, the port and starboard battery banks being located axially above the port and starboard rear ballast cavities, respectively.

In other or the same embodiments, the electric motor causes rotation of a driveshaft for the propulsor, the driveshaft being located laterally between and axially below the port and starboard batteries. The port and starboard rear ballast cavities may be at least partially defined by fiberglass sidewalls. Port and starboard base plates may be located axially on top of the port and starboard battery banks, wherein the port and starboard base plates comprise foam configured to reduce noise, vibration and harshness. The marine vessel may have a center of buoyancy and wherein the port and starboard battery banks are located longitudinally between the stern and the center of buoyancy. The port and starboard rear ballast cavities may be longitudinally closer to the stern than the bow. A front ballast cavity may be located longitudinally closer to the bow than the stern, the front ballast cavity being configured to take on ballast water for modifying a wake produced by the marine vessel in the water. A power distribution unit may be configured to control supply of the battery power to and from the port and starboard battery banks, the power distribution unit being located laterally between the port and starboard battery banks.

In other or the same embodiments, a hatch may be located laterally between the port and starboard battery banks, wherein the hatch contains a power distribution unit. An access lid on the hatch is movable into and between a closed position enclosing the power distribution unit and an open position providing access to the power distribution unit. A gas spring assist device is for assisting movement of the access lid. A power distribution unit is configured to control a supply of the battery power to and from the port and starboard battery banks, the power distribution unit being located in the hatch. A supporting frame supports the power distribution unit, the supporting frame located axially beneath the power distribution unit and laterally between the port and starboard battery banks. At least one vibration dampening isolator supports the power distribution unit relative to the supporting frame, reducing noise, vibration and harshness. The supporting frame may be configured to prevent laterally inward movement of the port and starboard battery banks, respectively.

In other or the same embodiments, a marine vessel comprises a hull and an electric motor configured to operate a propulsor for generating a propulsive force for propelling the marine vessel in water. Port and starboard rear ballast cavities are configured to take on ballast water for modifying a wake produced by the marine vessel in the water, and port and starboard battery banks for are providing battery power to the electric motor, the port and starboard battery banks being located axially above the port and starboard rear ballast cavities, respectively, and being spaced apart from each other such that a hatch is defined therebetween. Port and starboard decks are located axially over the port and starboard rear ballast cavities such that port and starboard battery compartments are located axially between the port and starboard decks and the port and starboard ballast cavities, with the access hatch therebetween, wherein the port and starboard battery banks, when installed in the port and starboard battery compartments have a length, a width and a height, and wherein the height is less than a width of the hatch in the lateral direction and wherein the length and width is greater than the width of the hatch in the lateral direction.

In other or the same embodiments, a method is for installing the port and starboard battery banks into the marine vessel examples disclosed herein, the method comprising providing a pulley system for hoisting, lowering and rotating each of the port and starboard battery banks, operating the pulley system to (a) lower a first one of the port and starboard battery banks into the access hatch, in an orientation wherein that the height of the first one of the port and starboard battery banks is extending in the lateral direction, (b) rotate the first one of the port and starboard battery banks until the height of the battery is extending in the axial direction while simultaneously laterally sliding the first one of the port and starboard battery banks into a first one of the port and starboard battery compartments, and (c) repeat steps a-b for a second one of the port and starboard battery banks. The method may further comprise adding a hang bracket on one side of each of the port and starboard battery banks to assist said laterally sliding.

In non-limiting embodiments, an electric propulsion device is for propelling a marine vessel in water, the electric propulsion device comprising an electric motor, a driveshaft assembly comprising a driveshaft which is caused to rotate by operation of the electric motor and an oil-filled driveshaft housing on the driveshaft, and a propulsor mounted on the driveshaft such that rotation of the driveshaft causes rotation of the propulsor, which generates a propulsive force in the water. The driveshaft may through a hull of the marine vessel. Roller bearings may support opposing ends of the driveshaft in the driveshaft housing. A strut may extending from the hull and supporting the driveshaft assembly. A thrust bearing supports the driveshaft housing with respect to the hull. The electric motor has an output shaft which is coupled to the driveshaft within a gear reduction box. A cardan universal joint couples the electric motor to the driveshaft. An adapter couples the cardan universal joint to the output shaft of the electric motor.

BRIEF DESCRIPTION OF THE DRAWINGS

Examples are provided with reference to the following drawing figures. The same numbers are used throughout to reference like features and components.

DETAILED DESCRIPTION OF THE DRAWINGS

Figure 1:
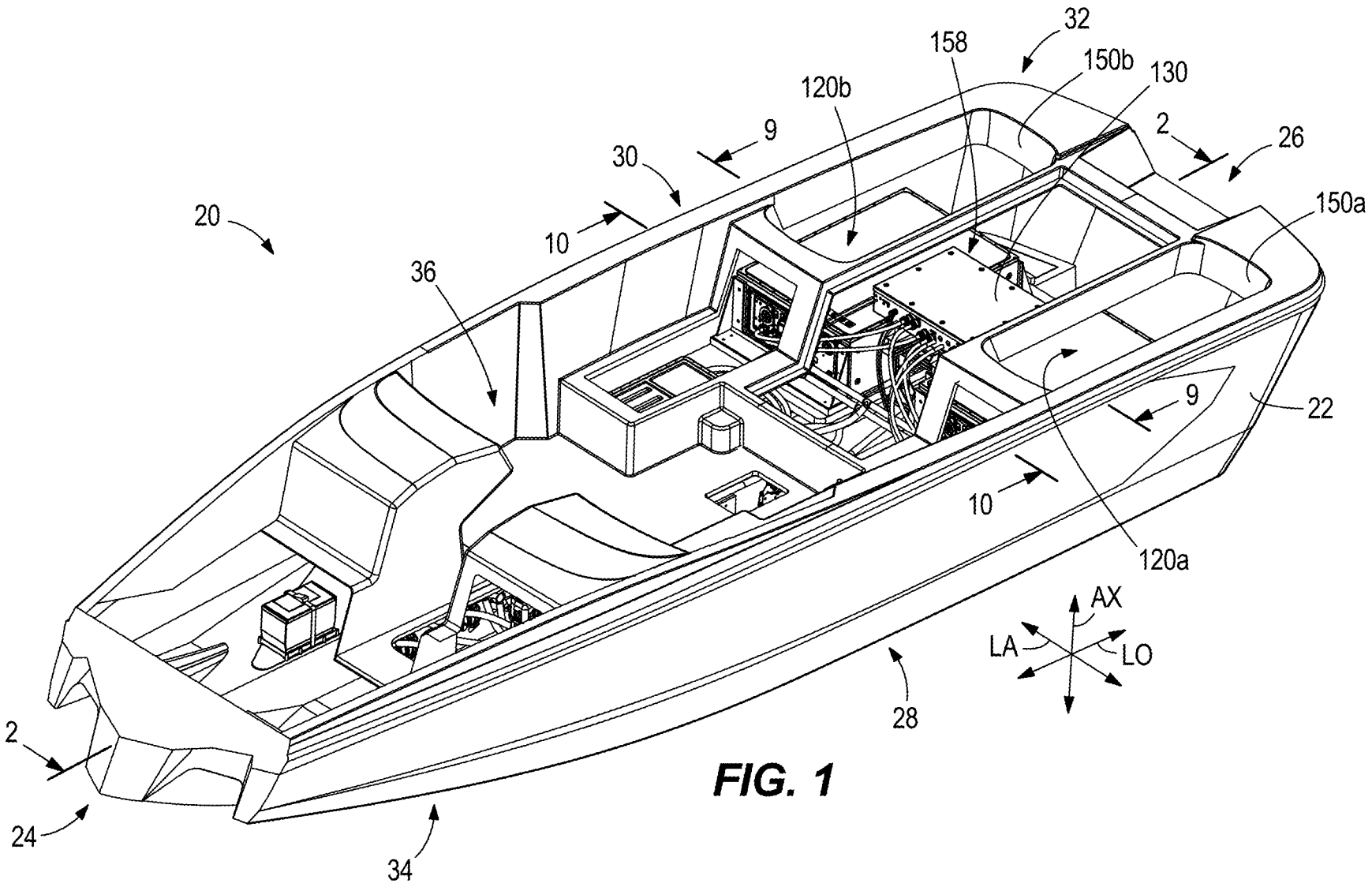
FIG. 1 is a perspective view of a marine vessel according to the present disclosure.

FIG. 1 is a perspective view of an exemplary embodiment of a marine vessel 20 according to the present disclosure. The marine vessel 20 has a hull 22 which extends from a bow 24 to a stern 26 in a longitudinal direction LO, from a port side 28 to a starboard side 30 in a lateral direction LA which is perpendicular to the longitudinal direction LO, and from top 32 to bottom 34 in an axial direction AX which is perpendicular to the longitudinal direction LO and perpendicular to the lateral direction LA. The type and configuration of the marine vessel 20 can vary widely from what is shown. In the illustrated example, the marine vessel 20 has various seating for occupants, some of which has been removed from the figures to better illustrate the configuration of the hull 22 and various components therein. The marine vessel 20 also has a helm 36, which is only partially shown to better illustrate various components. From the helm 36, the operator of the marine vessel 20 is able to control navigation of the marine vessel 20.

Referring to FIGS. 2-6, the marine vessel 20 has an electric propulsion device 40 for propelling the marine vessel 20 in the water. Generally, the electric propulsion device 40 includes an electric motor 42, a driveshaft assembly 44 including a driveshaft 46 which is caused to rotate by operation of the electric motor 42, and a propulsor 48 mounted on the driveshaft 46 such that rotation of the driveshaft 46 causes rotation of the propulsor 48, which generates a propulsive force in water. The type and configuration of electric motor 42 can vary and in the example shown is a commercially available electric motor sold by the Marelli Motori Group, model number PSM245. The electric motor 42 has an output shaft 50 which is coupled to the driveshaft 46 by various intermediate components such that rotation of the output shaft 50 causes rotation of the driveshaft 46. The type and configuration of the intermediate components can vary from what is shown. In the illustrated example, the output shaft 50 is coupled via an adapter plate 52 to a commercially available gear reduction box 54 sold by Torque Trends, 1.9:1 transmission. The output of the gear reduction box 54 is coupled via an adapter flange ring 56 to a commercially available cardan universal joint 58 sold by Seatorque Control Systems, model number M3-100. Advantageously, the cardan universal joint 58 includes a slip yoke, which permits axial slip which prevents fore-aft loading on the driveshaft assembly from damaging or otherwise interfering with functionality of the components. The output of the cardan universal joint 58 is coupled by a yoke input adapter 60 to a driveshaft extension 62 extending through a thrust bearing housing 64. The thrust bearing housing 64 is resiliently mounted to an end wall 66 in the hull 22, which is located at the forward end of a recess 68 formed in the bottom of the hull 22. The thrust bearing housing 64 is coupled to the end wall 66 by through-bolts 70 extending through neoprene isolators 73, such that the thrust bearing housing 64 and associated coupling prevents water intrusion and also provides vibration isolation for the electric propulsion device 40.

The driveshaft 46 extends through the hull 22 and has an inner end 72 coupled to the driveshaft extension 62 and an outer end 74 on which the propulsor 48 is mounted. A majority of the driveshaft 46 is contained within an oil-filled driveshaft housing 80. The oil-filled driveshaft housing 80 has an outer end 82 which is rigidly suspended from the bottom of the hull 22 by a strut 84 and an inner end 86 which is coupled to the end wall 66 in the hull 22 at the thrust bearing housing 64. Roller bearings 88 in the thrust bearing housing 64 support rotation of the inner end 72 of the driveshaft. Roller bearings 90 in an end cap 92 on the oil-filled driveshaft housing 80 support rotation of the outer end 74 of the driveshaft 46. In the illustrated example, the propulsor 48 is a propeller which is splined to the outer end 74 of the driveshaft 46, however the type and configuration of the propulsor 48 can vary from what is shown.

Figure 2:
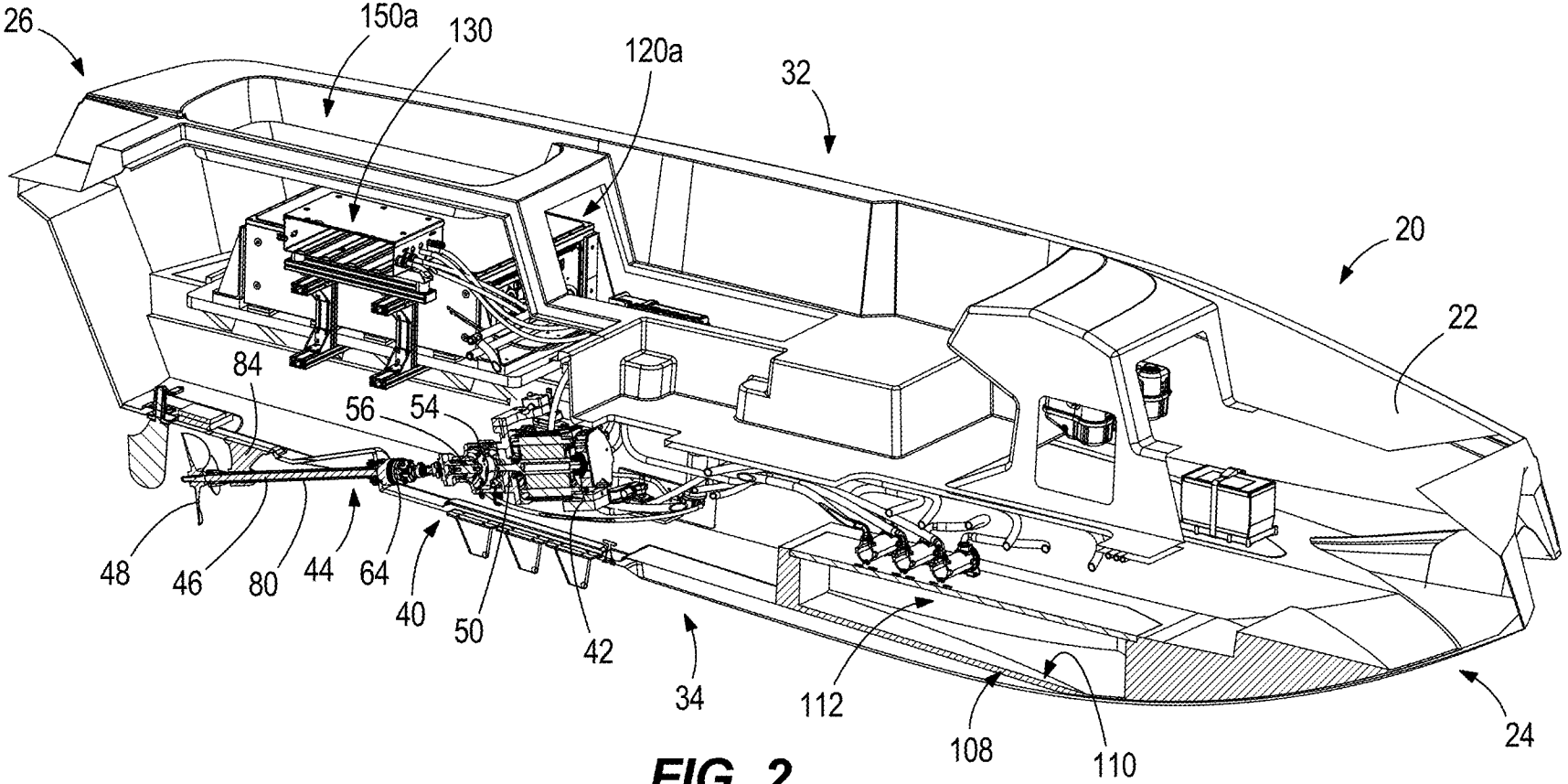
FIG. 2 is a view of section 2-2, taken in FIG. 1.
Figure 3:
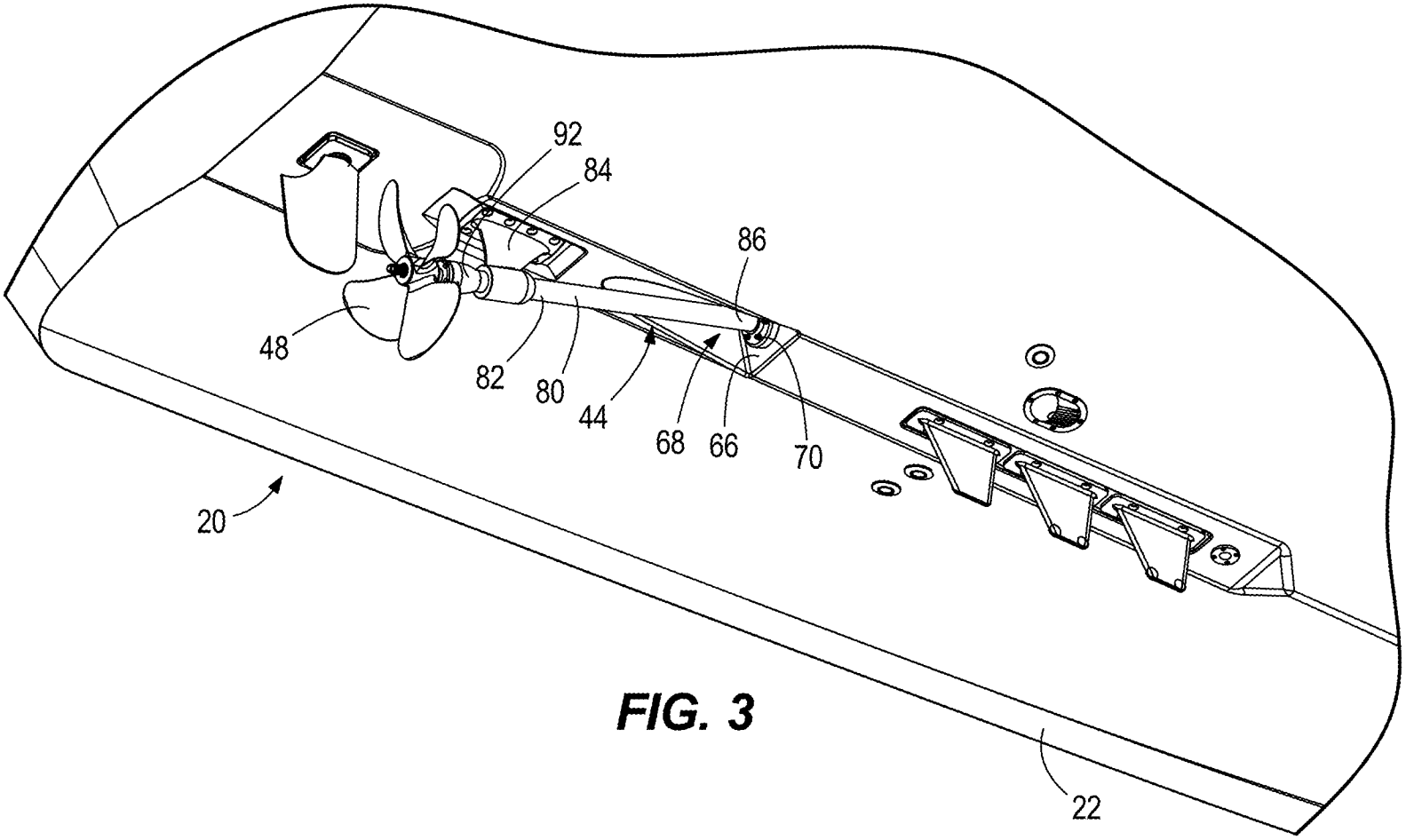
FIG. 3 is a view looking up at the bottom of the hull of the marine vessel, showing the driveshaft assembly extending through the hull and having a propulsor.
Figure 4:
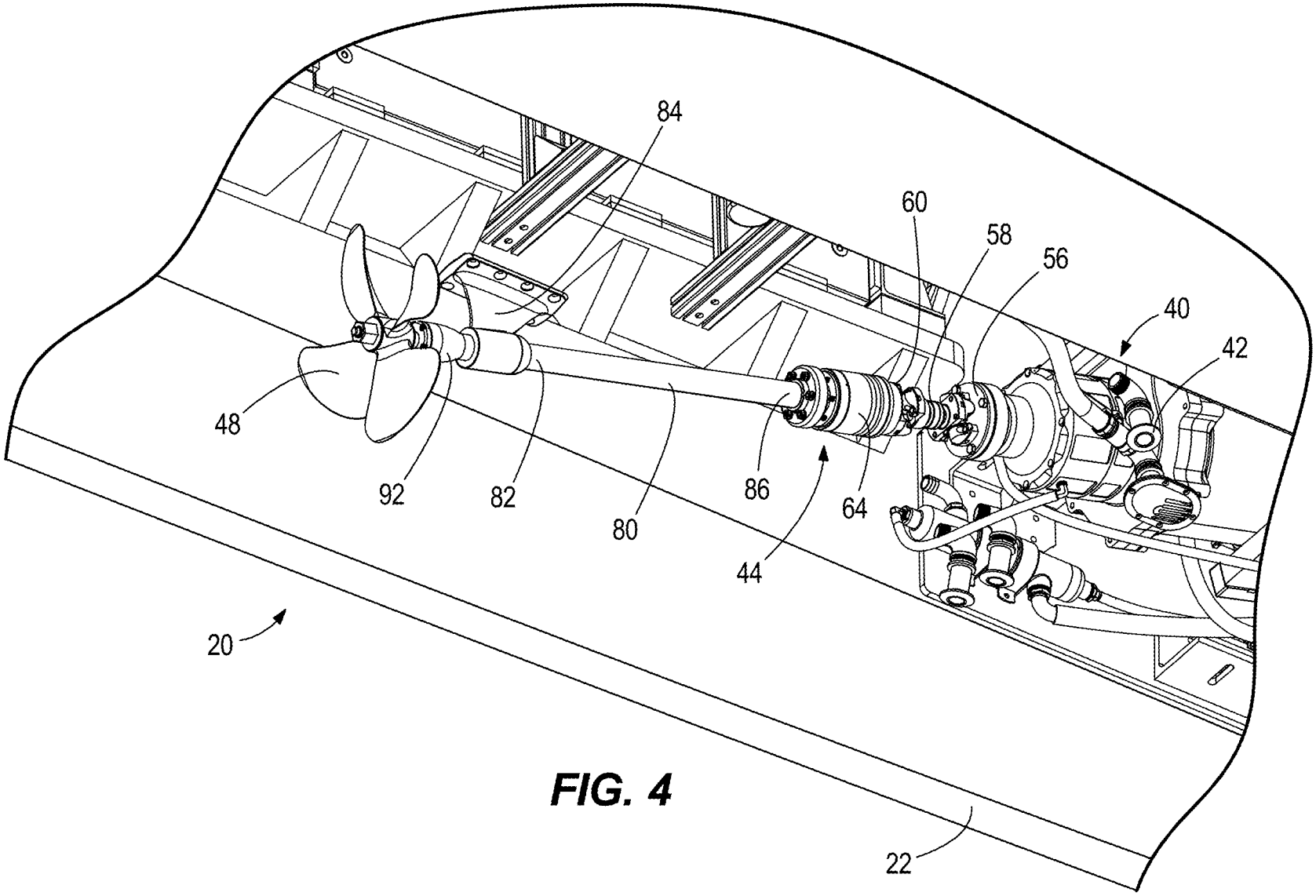
FIG. 4 is a view of the electric motor, driveshaft assembly and propulsor with the bottom of the hull removed.
Figure 5:
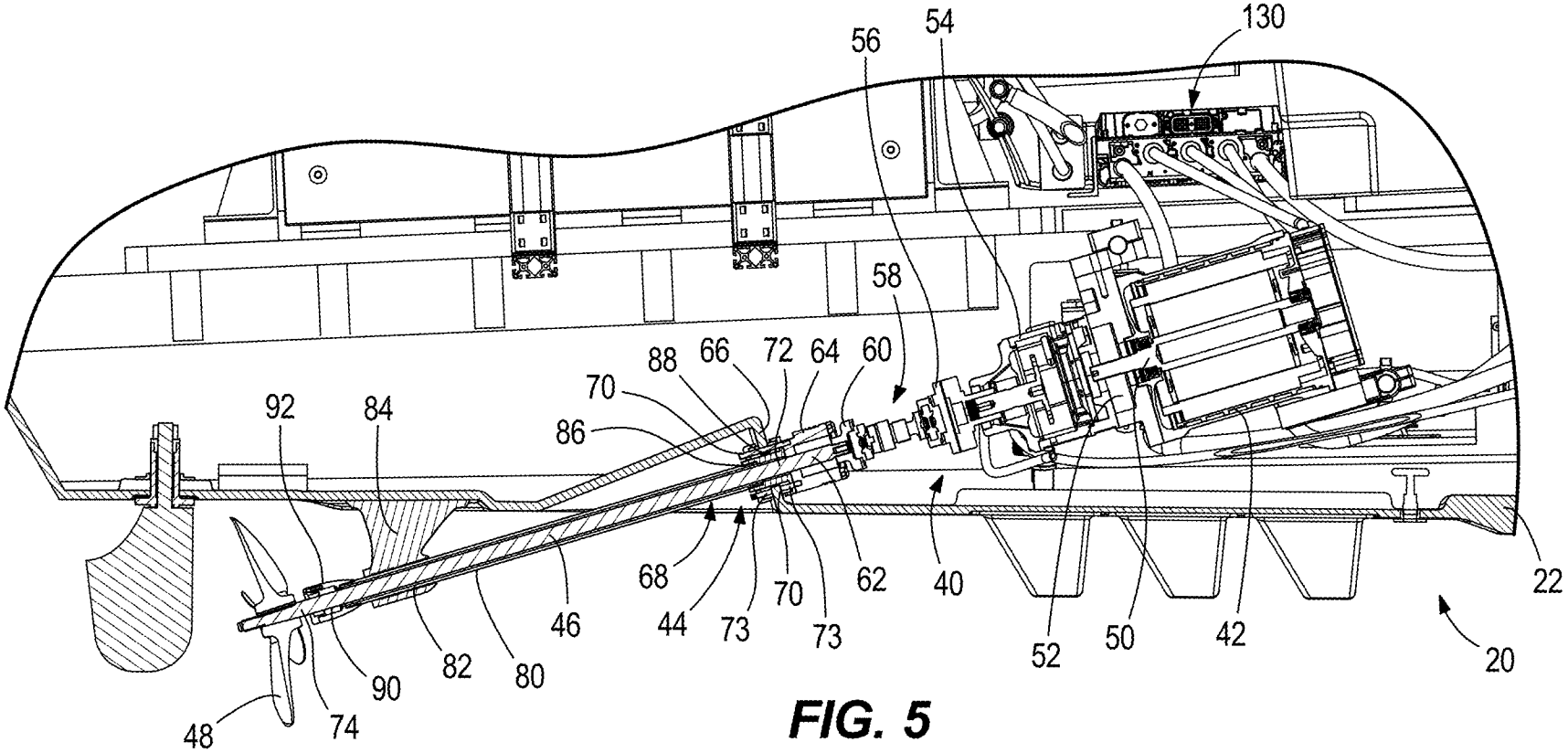
FIG. 5 is a side sectional view of the motor, driveshaft assembly and propulsor.
Figure 9:
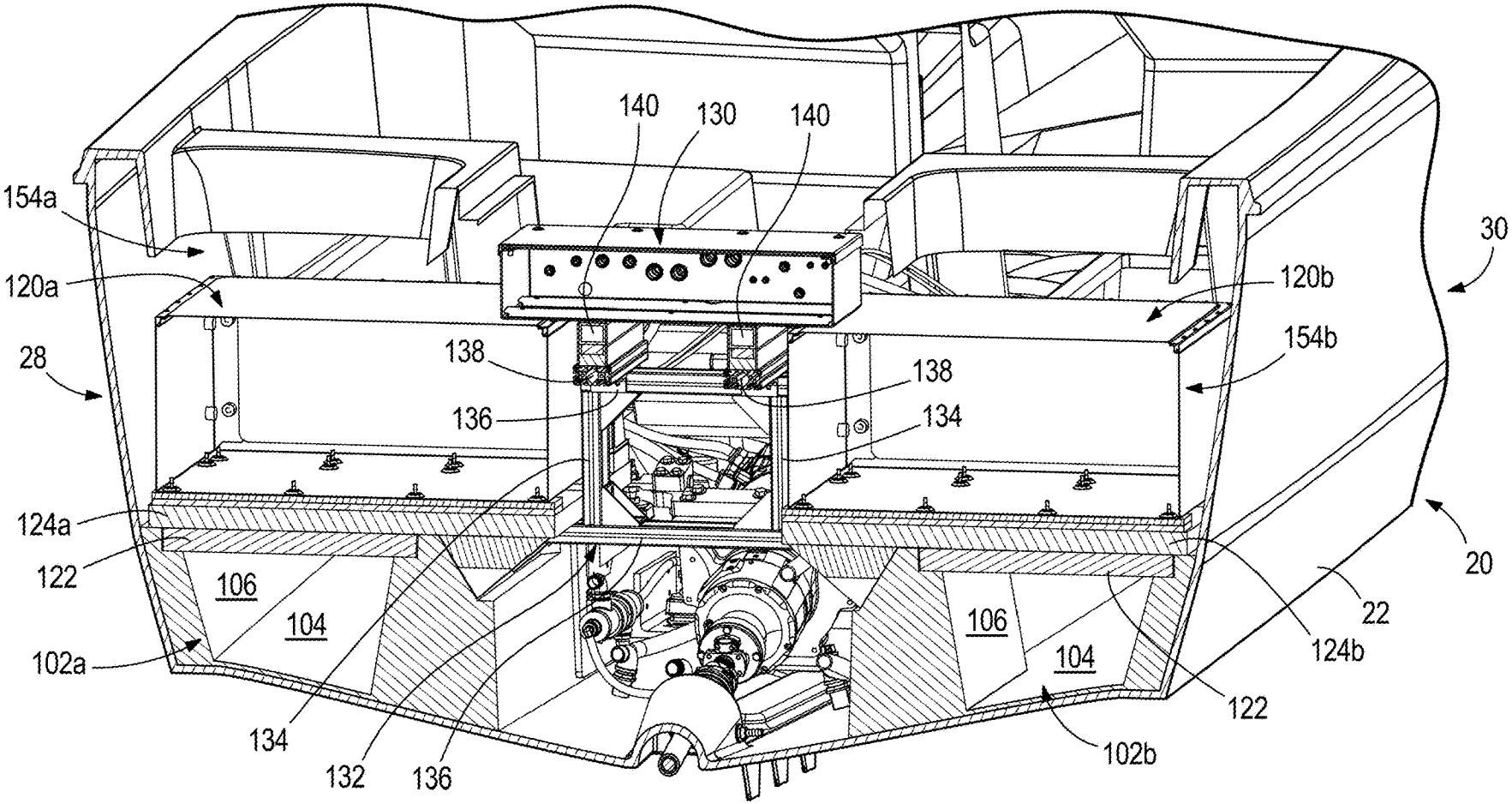
FIG. 9 is a perspective view of section 9-9, taken in FIG. 1.
Figure 10:
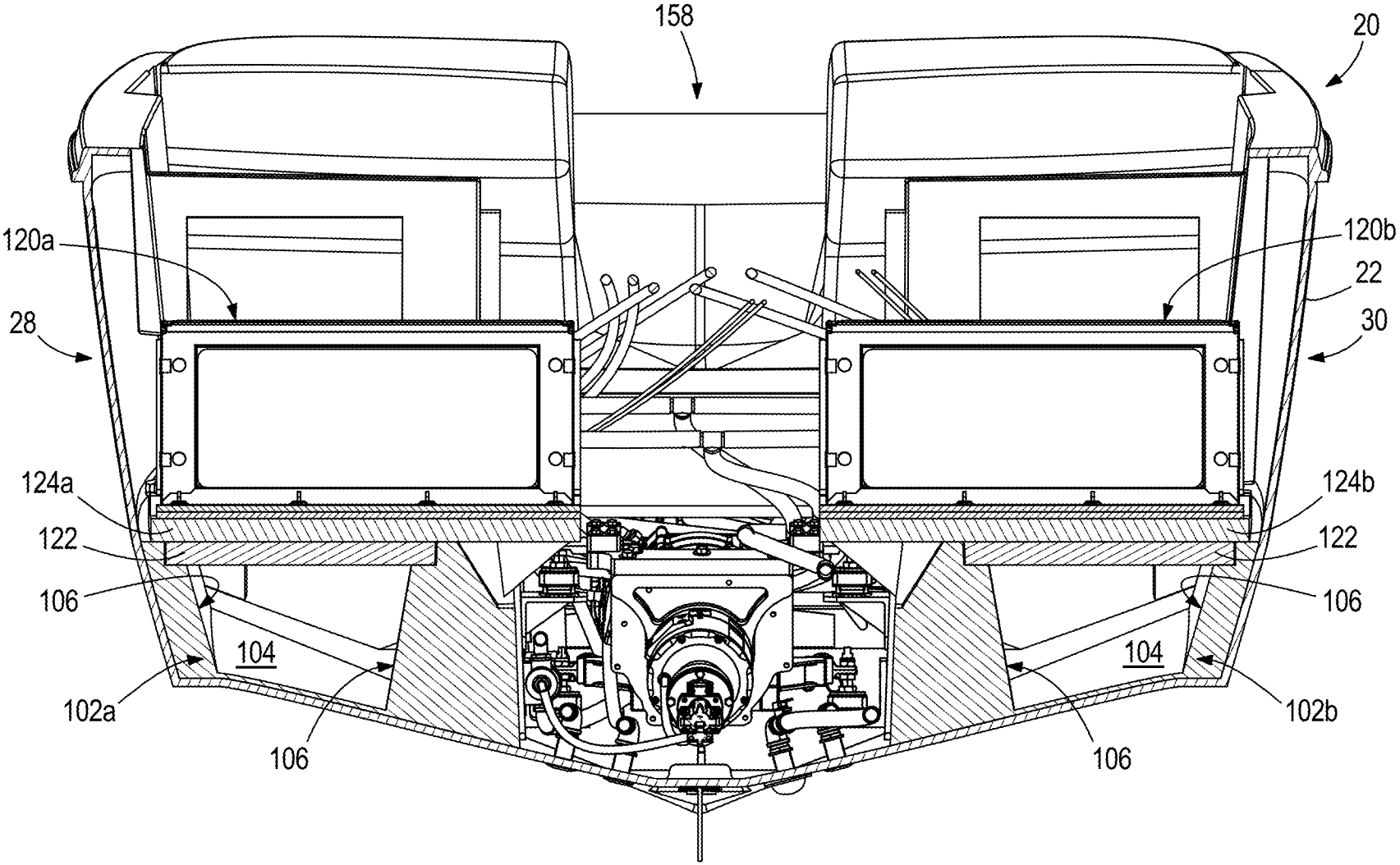
FIG. 10 is a plan view of section 10-10, taken in FIG. 1.
Figure 11:
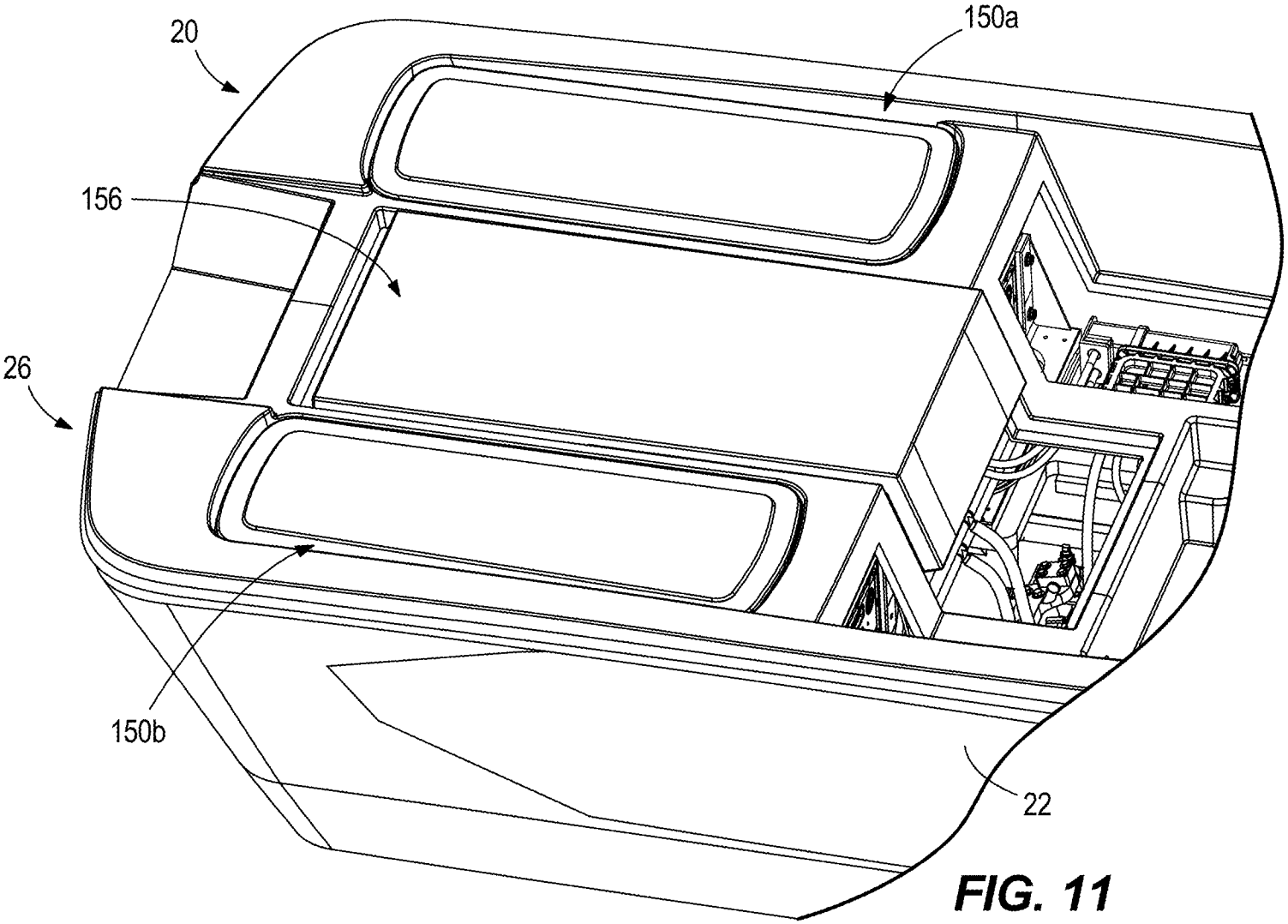
FIG. 11 is a perspective view looking down at the rear of the marine vessel showing an access lid in its closed position.
Figure 12:
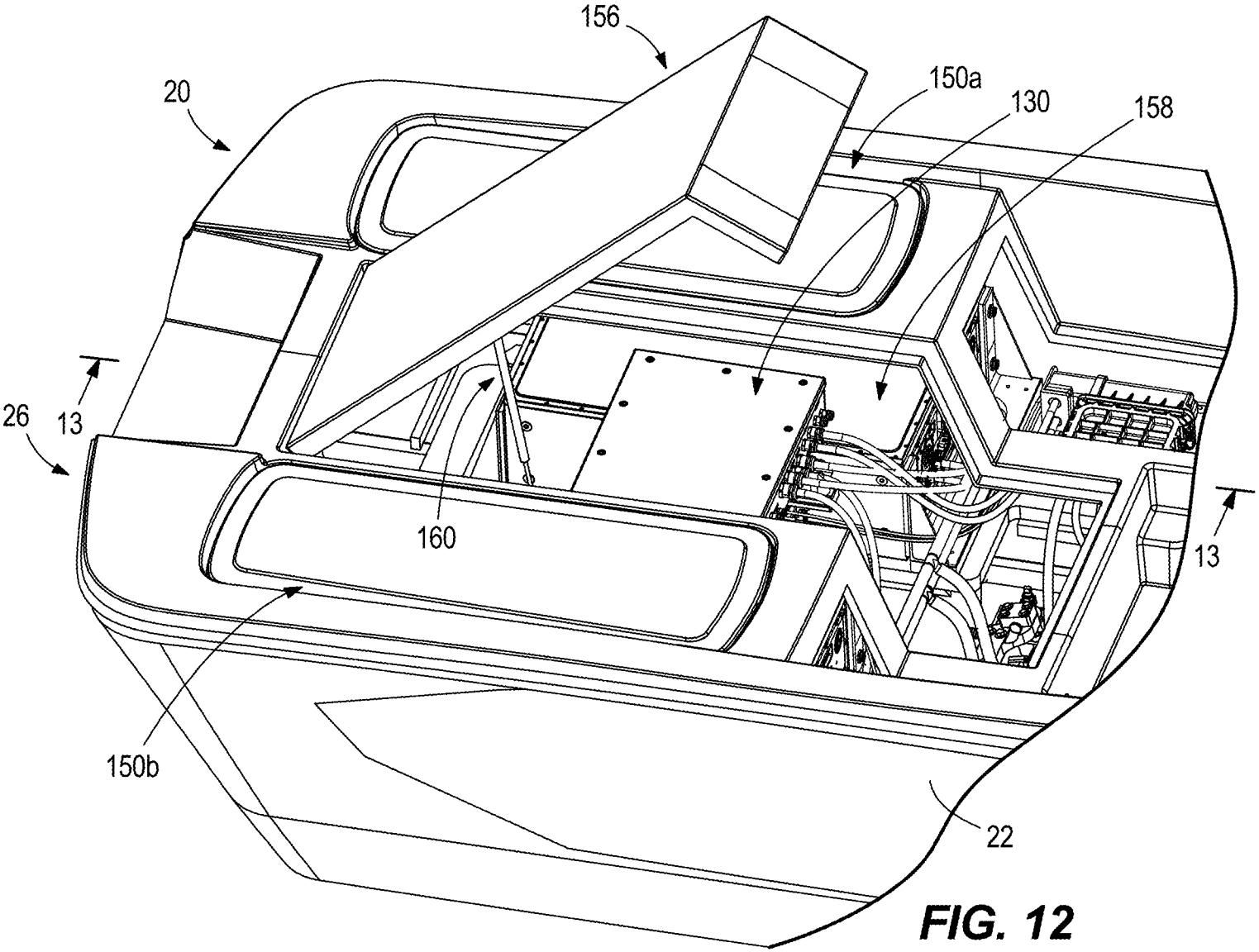
FIG. 12 is a view like FIG. 11 showing the access lid in its open position.
Figure 13:
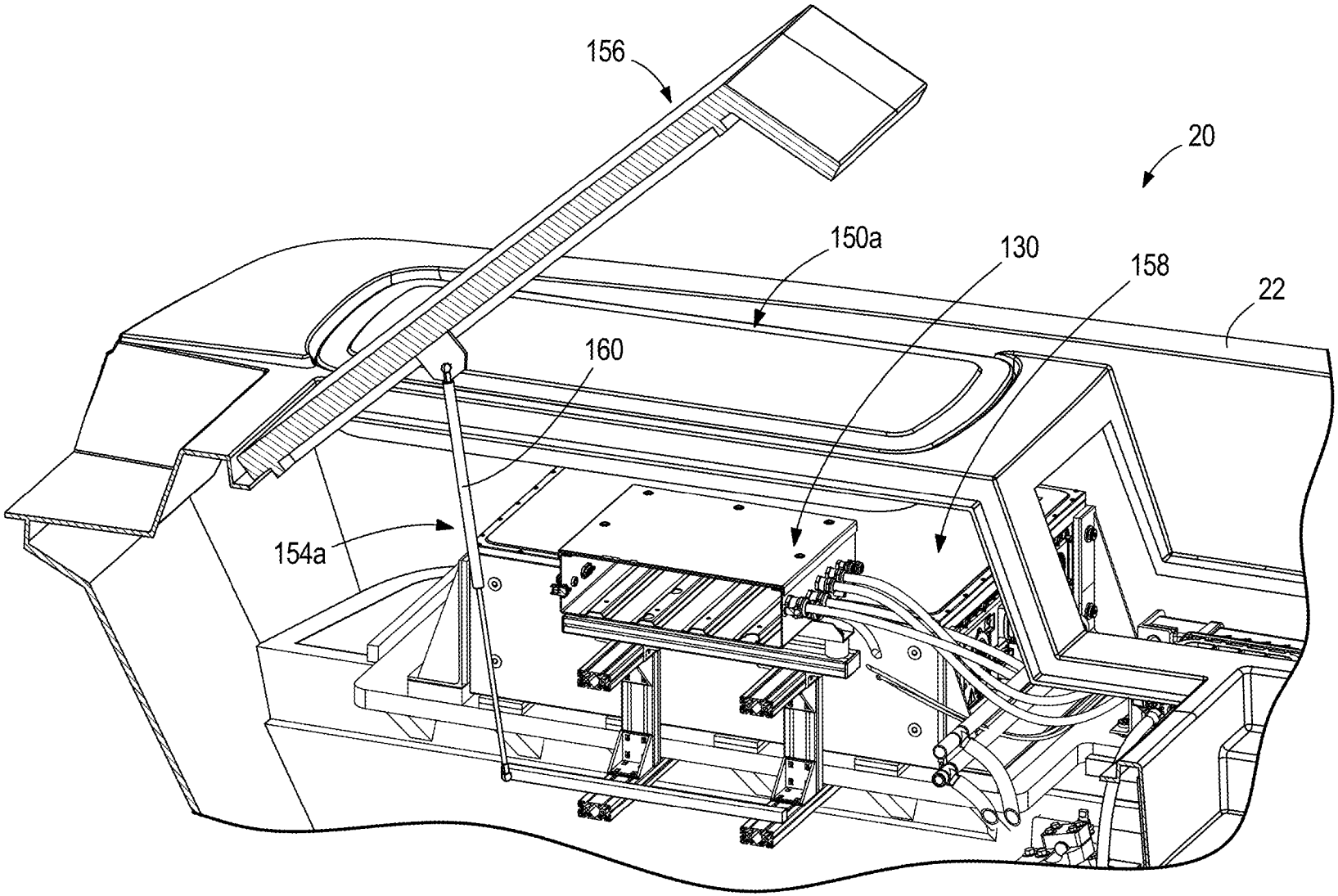
FIG. 13 is a sectional view of the rear of the marine vessel and access lid in the open position.

Referring now to FIGS. 9-10, the marine vessel 20 has port and starboard rear ballast cavities 102*a*, 102*b* which are configured to take on ballast water for modifying a wake produced by the marine vessel 20 in water. The port and rear ballast cavities 102*a*, 102*b* are generally located near the stern 26, such that they are longitudinally closer to the stern 26 than the bow 24. Each of the port and rear ballast cavities 102*a*, 102*b* has a bottom surface 104 and sidewalls 106 which are formed as part of the hull 22, which for example is made of fiberglass. Referring to FIG. 2, the marine vessel 20 also has a front ballast cavity 108 which is configured to take on ballast water for modifying the wake produced by the marine vessel 20. The front ballast cavity 108 is longitudinally closer to the bow 24 than the stern 26, and similar to the port and starboard rear ballast cavities 102*a*, 102*b*, has a bottom surface 110 and sidewalls 112 which are formed as part of the hull 22. A lid 114 is positioned on top of the sidewalls 112 to enclose the front ballast cavity 108. As conventional, the marine vessel 20 includes positive displacement pumps which are configured to control inflow and outflow of seawater to and from the port and starboard rear ballast cavities 102*a*, 102*b* and the front ballast cavity 108, providing the operator of the marine vessel 20 with active control over the distribution of ballast in the marine vessel 20 and thus active control over the wake. What is shown and described is a conventional ballast system, the nature of which is well understood by one having ordinary skill in the art and thus further description is not needed here.

The marine vessel 20 also has a battery system comprising port and starboard battery banks 120*a*, 120*b*, which are configured to provide battery power to the electric motor 42 and various other system components. The type and configuration of battery bank can vary from what is shown. In the illustrated example, the battery banks are commercially available from Kreisel Electric, model number KBP63. Advantageously, the port and starboard battery banks 120*a*, 120*b* are located axially above the port and starboard rear ballast cavities 102*a*, 102*b*, respectively. Referring to FIGS. 9-10, each of the port and starboard rear ballast cavities 102*a*, 102*b* have a top wall 122 seated on top of the sidewalls 106 and enclosing the rear ballast cavities 102*a*, 102*b*. Additionally, port and starboard base plates 124*a*, 124*b* are mounted on top of the top wall 122, and on top of the sidewalls 106. The base plates 124*a*, 124*b* underlie and support the port and starboard battery banks 120*a*, 120*b*, respectively. Optionally the base plates 124*a*, 124*b* are made of a foam material and so are configured to reduce noise, vibration and harshness.

A power distribution unit 130 is provided for controlling/regulating the supply of battery power to and from the port and starboard battery banks 120*a*, 120*b*. The type and configuration of the power distribution unit 130 can vary from what is shown. Referring to FIGS. 9 and 10, the power distribution unit 130 is positioned laterally between the port and starboard battery banks 120*a*, 120*b*. A supporting frame 132 supports the power distribution unit 130 in position axially above and laterally between the port and starboard battery banks 120*a*, 120*b*. The supporting frame 132 includes laterally opposed support columns 134 and axially spaced beams 136 which together extend laterally between the port and starboard rear ballast cavities 102*a*, 102*b*. Advantageously, the supporting frame 132 is configured to brace the port and starboard battery banks 120*a*, 120*b* and prevent the port and starboard battery banks 120*a*, 120*b* from falling laterally into the space therebetween, in a situation where either one of the port and starboard battery banks 120*a*, 120*b* become dislodged from its position over the port and starboard rear ballast cavities 102*a*, 102*b*. Longitudinally extending support beams 138 are located on top of the supporting frame 132 and underlie a pair of vibration dampening isolators 140. The vibration dampening isolators 140 underlie and support the power distribution unit 130 relative to the supporting frame 132 and provide reduction in noise, vibration and harshness.

Referring to FIGS. 1, 2, and 11-13, the marine vessel 20 has port and starboard decks 150*a*, 150*b* and/or port and starboard seating 152*a*, 152*b* which overlie the port and starboard battery banks 120*a*, 120*b* and thus define port and starboard battery compartments 154*a*, 154*b* for the port and starboard battery banks 120*a*, 120*b*. An access lid 156 spans the lateral and longitudinal space between the port and starboard decks 150*a*, 150*b* and encloses the power distribution unit 130 such that a hatch 158 is provided for the power distribution unit 130. The access lid 156 is manually pivotable about its rear end into and between a closed position enclosing the power distribution unit 130 in the hatch 158 and an open position providing access thereto. A gas assist spring 160 is configured to assist movement of the access lid 156 into the open position and to prevent free fall of the access lid 156 into the closed position.

Figure 7:
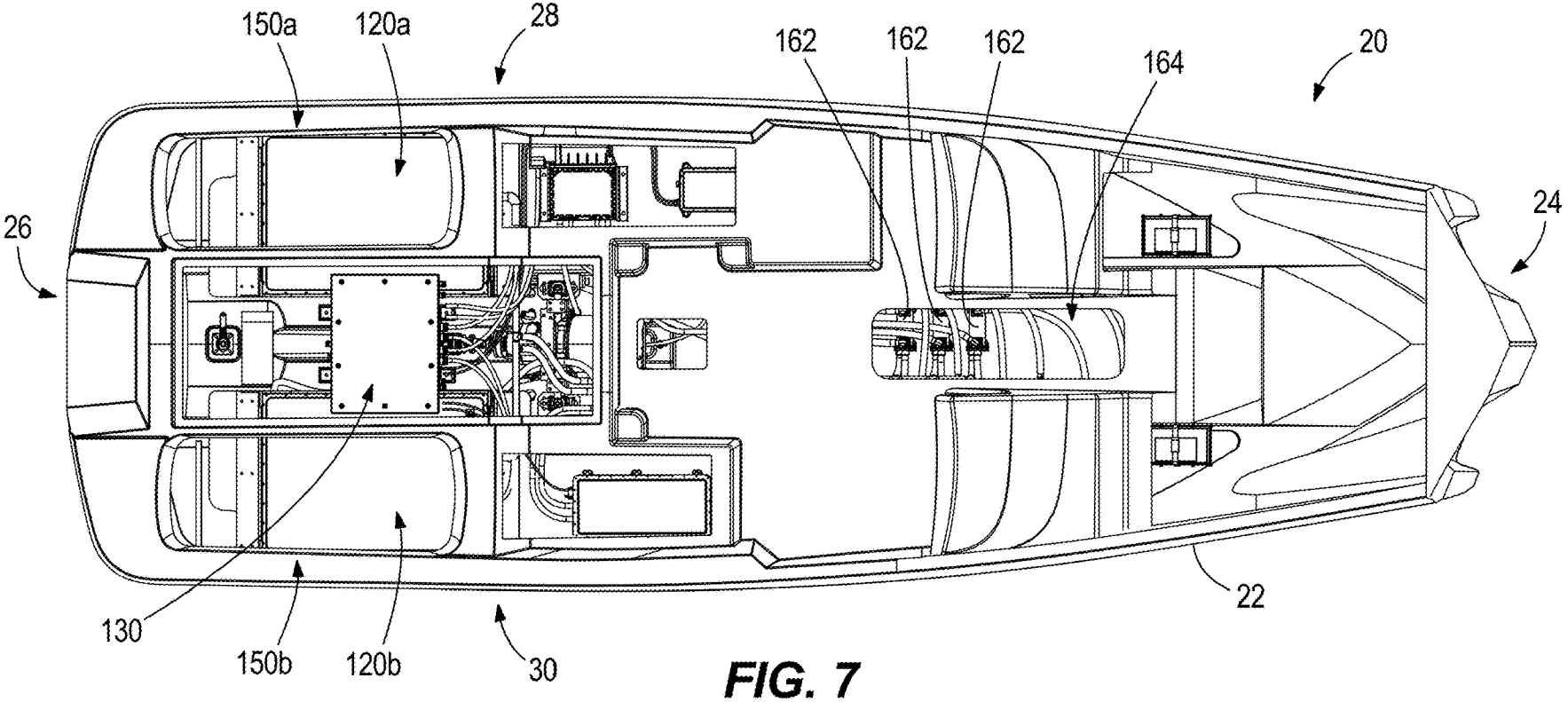
FIG. 7 is a sectional view looking down at the marine vessel.
Figure 8:
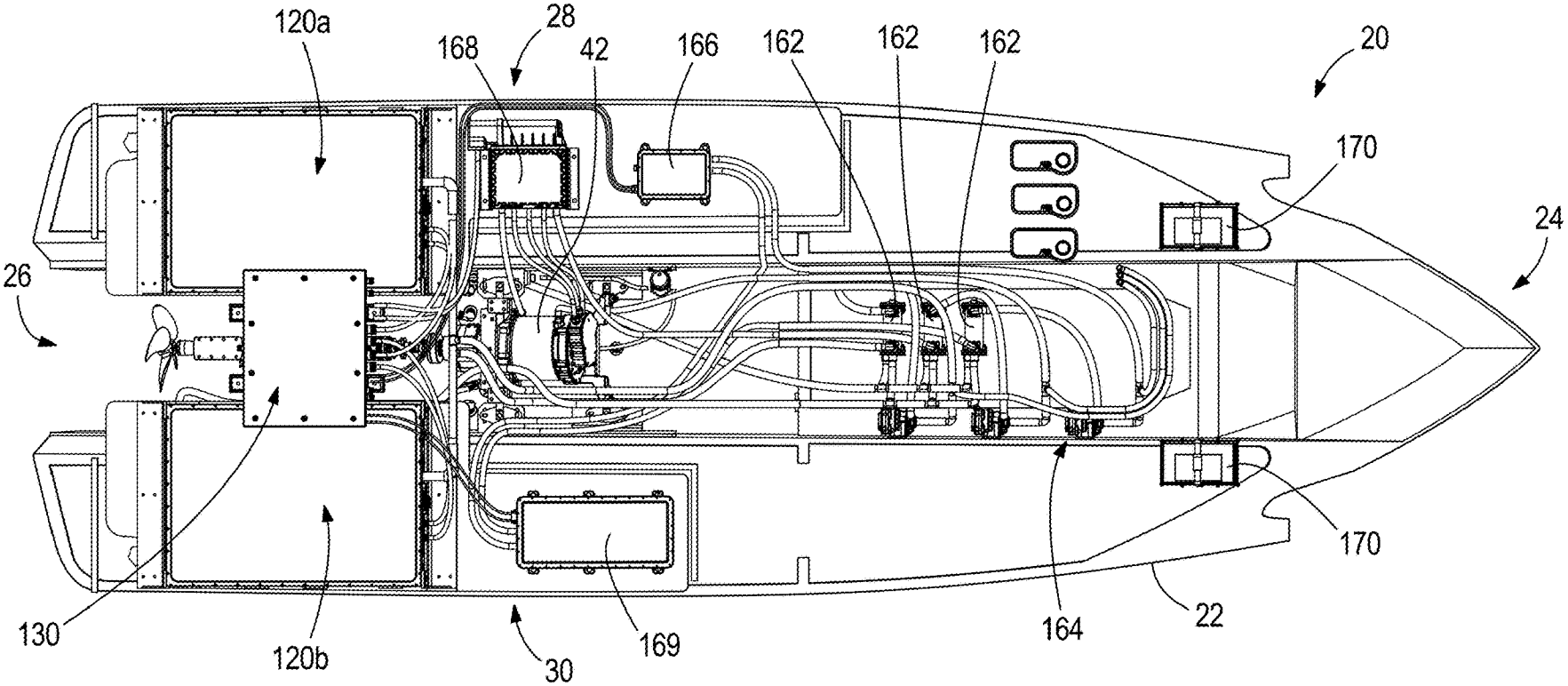
FIG. 8 is another sectional view looking down at the marine vessel.

Referring to FIGS. 7-8, the electric propulsion device 40 is located laterally between and axially below the port and starboard rear ballast cavities 102*a*, 102*b* and the port and starboard battery banks 120*a*, 120*b*. The marine vessel inherently has a center of buoyancy and the port and starboard battery banks 102*a*, 120*b* are located longitudinally between the stern and the center of buoyancy. Additional components which have weight and thus factor into the balance of the marine vessel 20 with respect to the center of buoyancy include three cooling pumps and tube and shell heat exchangers 162 located in an access locker 164, forwardly of the electric motor 42, for example providing cooling fluid to system components such as the port and starboard battery banks 120*a*, 120*b*, a DC/DC converter 166, an inverter 168, an L2 charger 169, etc. A pair of 12-volt batteries 170 are located closer to the bow 24 and are configured to provide battery power to various onboard electronic components, such as trim tabs, stereo, helm gauges and other electronics, etc.

Figure 14:
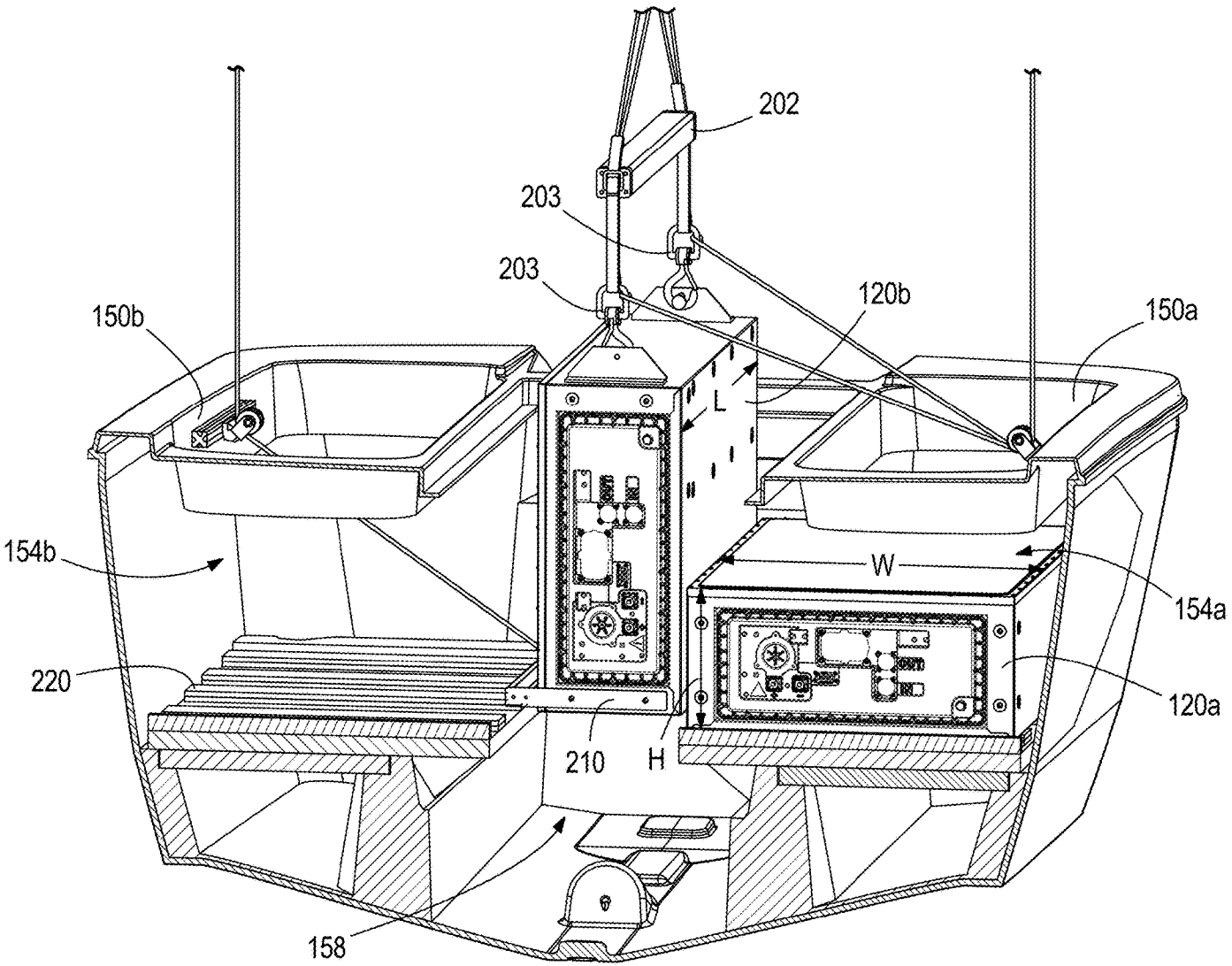
FIGS. 14-21 show a sequence of steps for installation of a battery assembly into the marine vessel.
Figure 15:
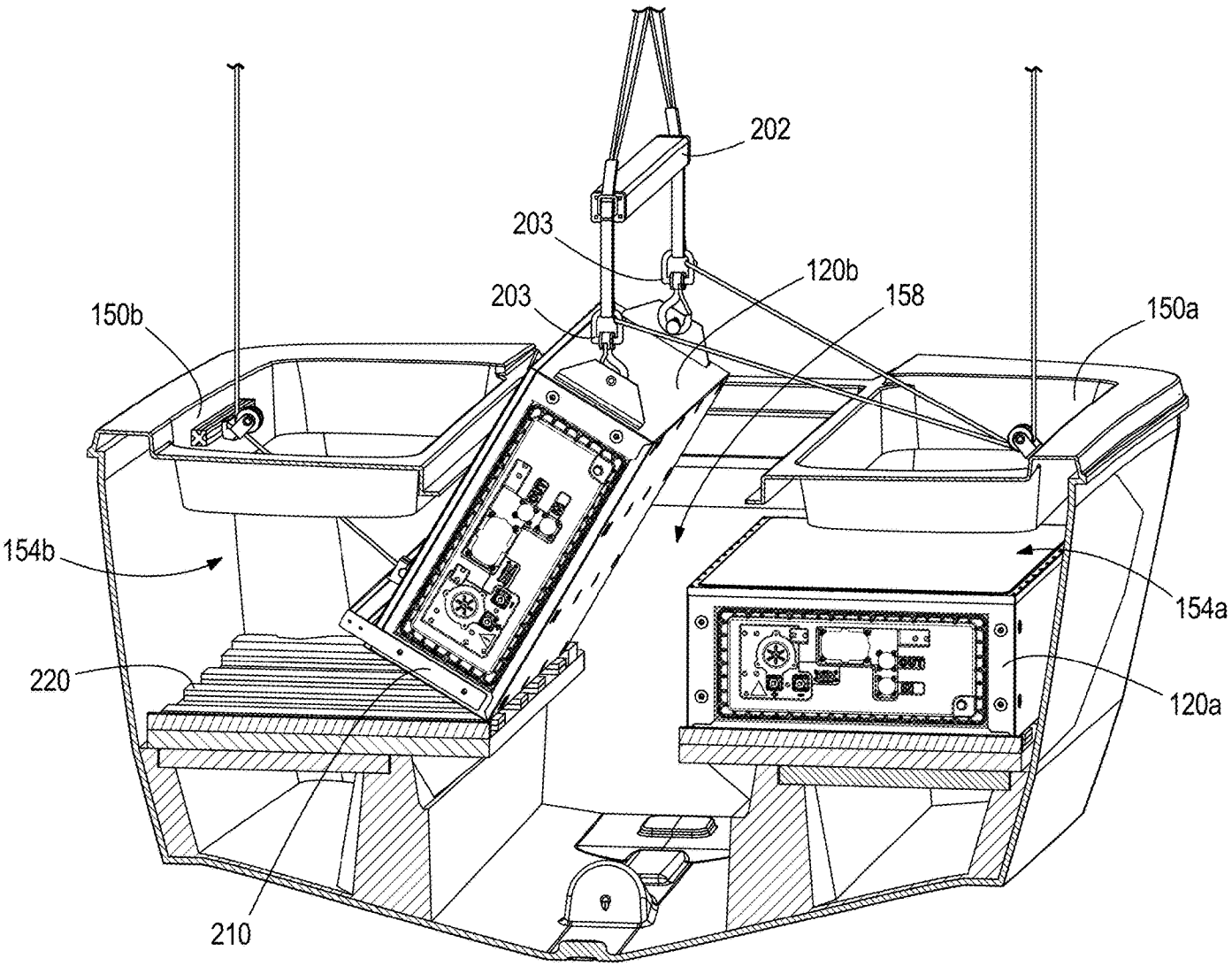
Figure 16:
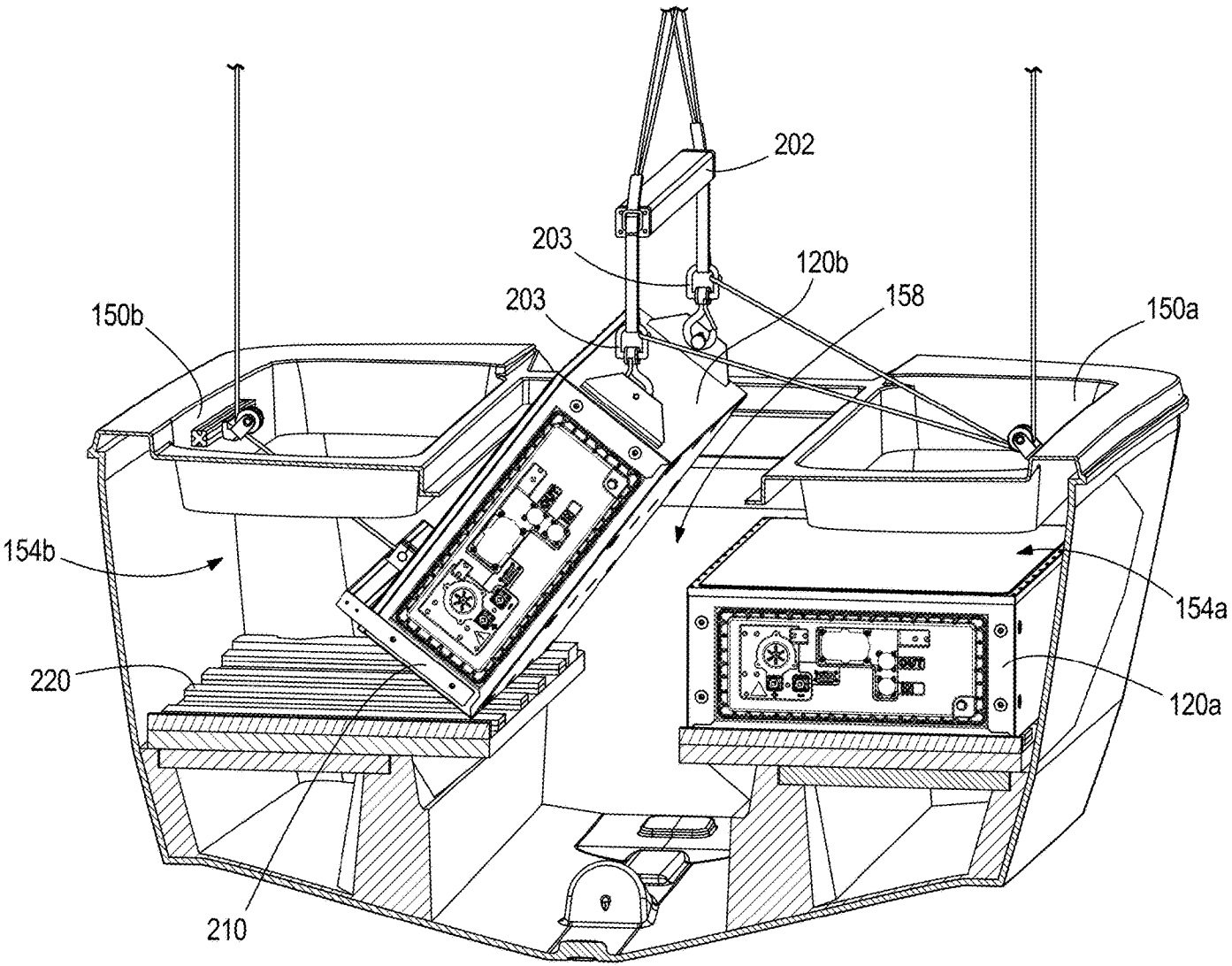
Figure 17:
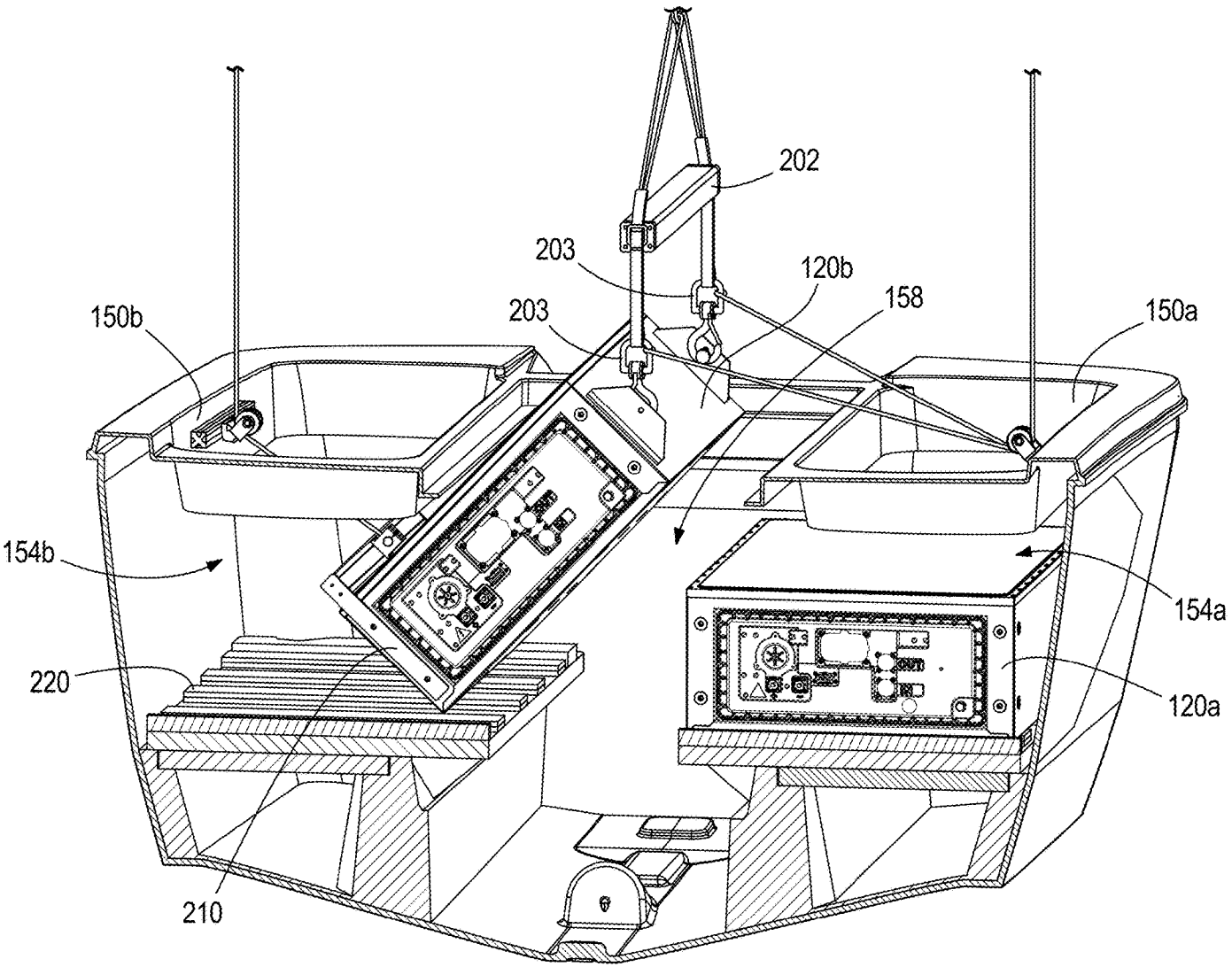
Figure 18:
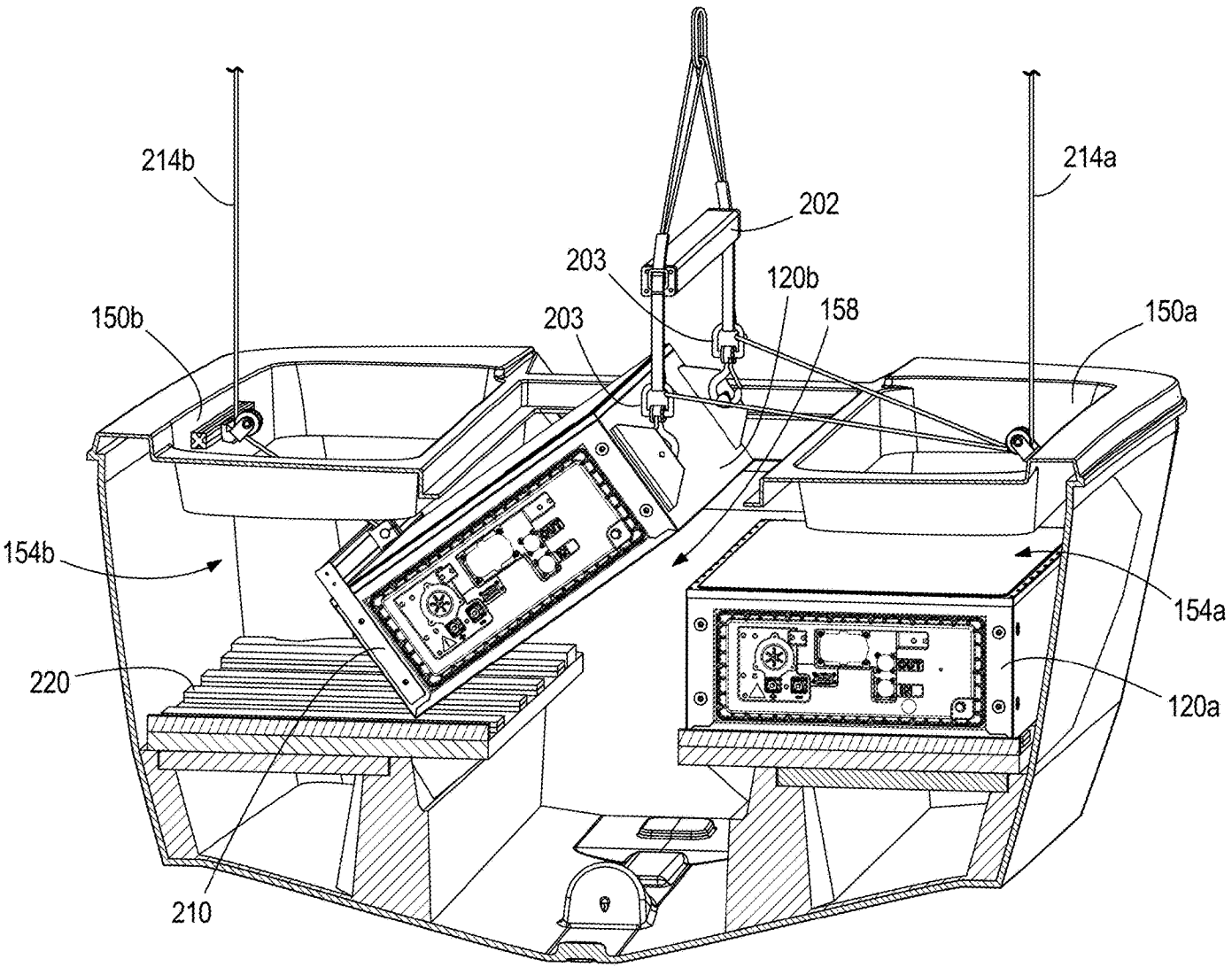
Figure 19:
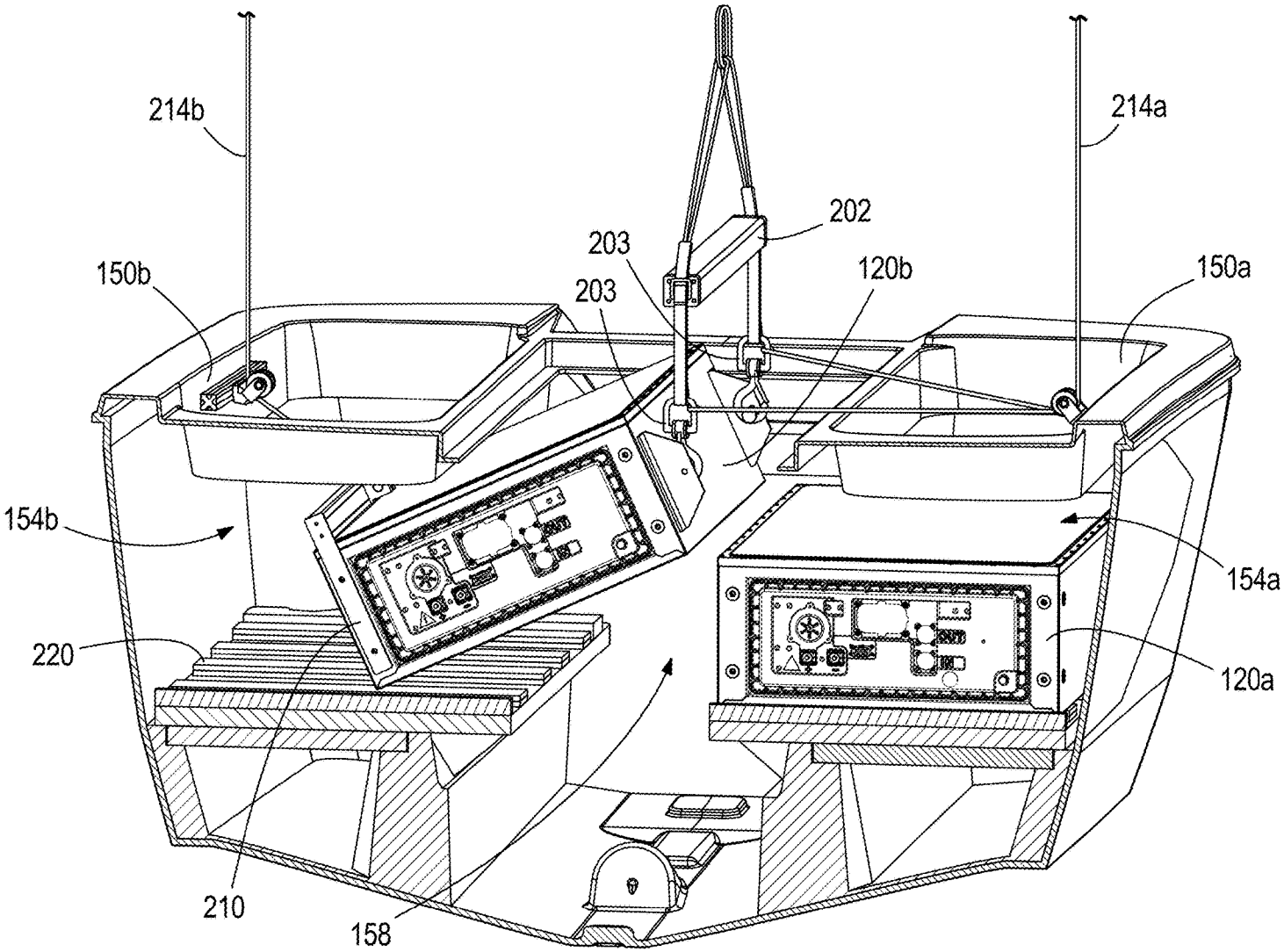
Figure 20:
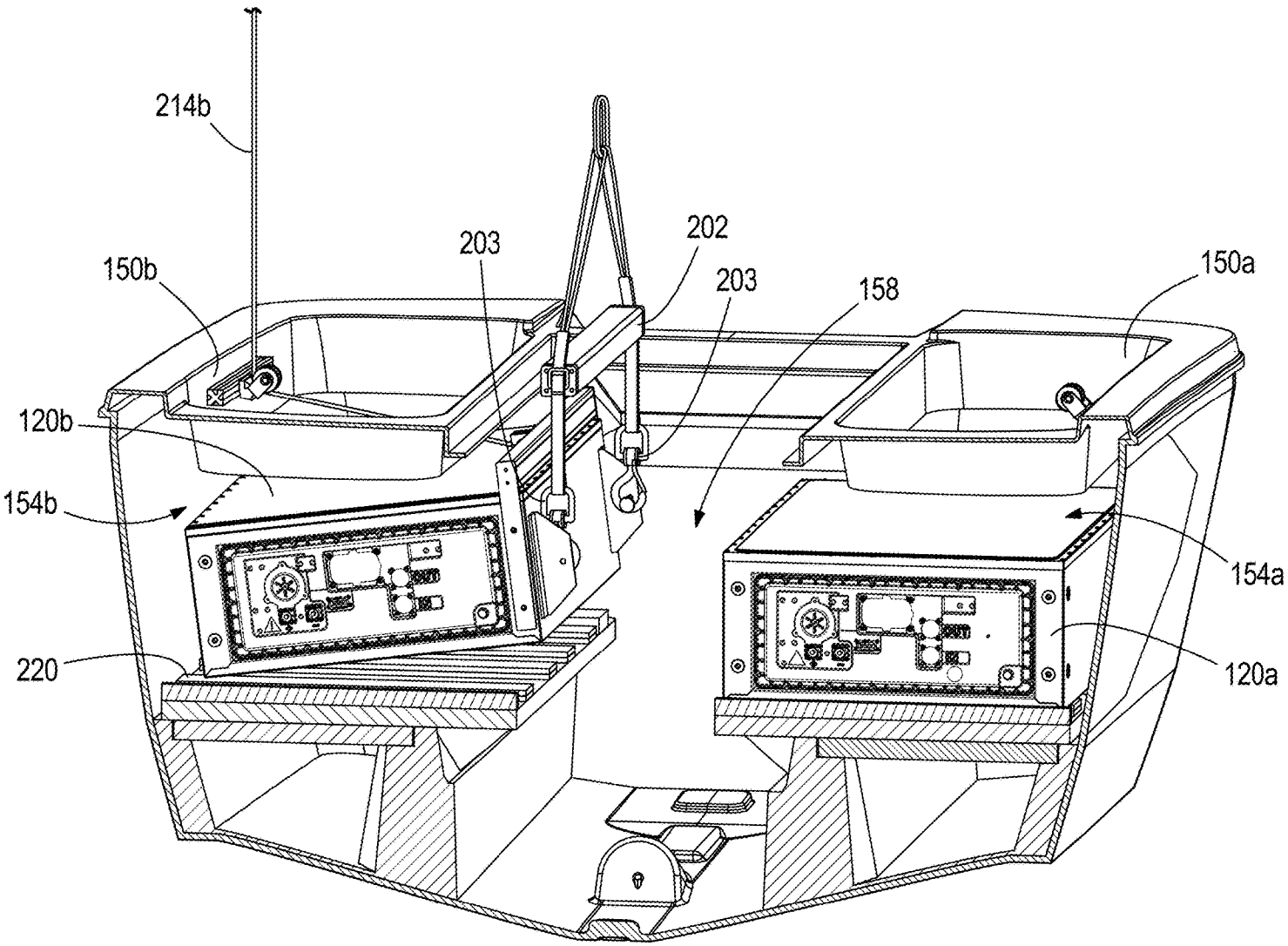
Figure 21:
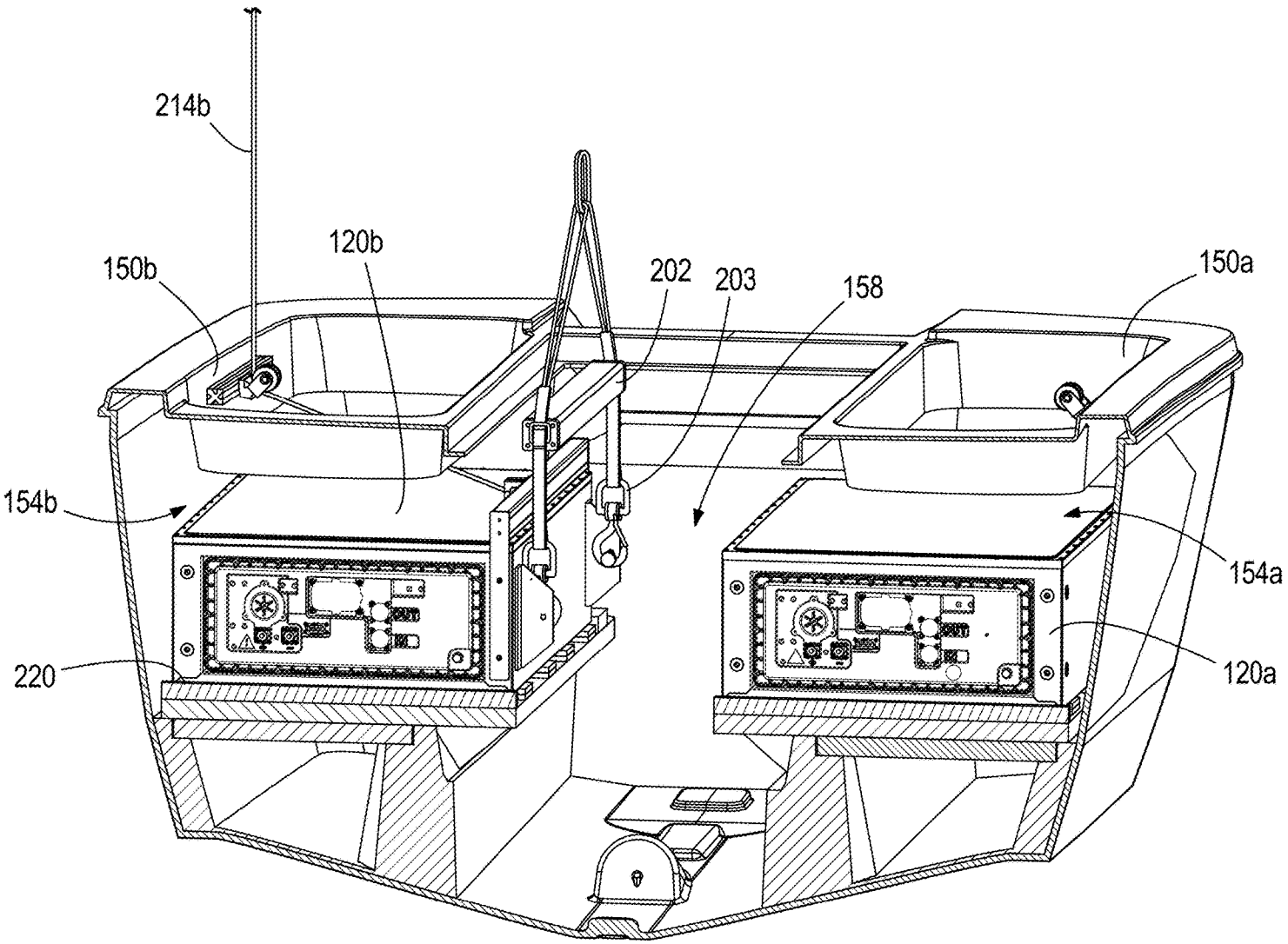

Referring now to FIG. 14, each battery bank 120*a*, 120*b* is generally box-shaped and has a length L, a width W, and a height H. The height H is less than the width of the hatch 158 in the lateral direction LA such that the respective battery bank 120*a*, 120*b* may be lowered from above into the hatch 158, as shown. However the length L and width W of each battery bank 120*a*, 120*b* are each greater than the width of the space between the battery compartments 154*a*, 154*b* (i.e. hatch 158) in the lateral direction LA. Thus the present inventor determined challenges associated with installing the battery banks 120*a*, 120*b* into the battery compartments 154*a*, 154*b* without damaging the battery banks 120*a*, 120*b* and/or the decks 150*a*, 150*b* in the process.

FIGS. 14-21 illustrate a sequence of method steps for installation of the port and starboard battery banks 120*a*, 120*b* into the respective battery compartments 154*a*, 154*b*. The figures illustrate the port battery bank 120*a* in an installed position in the port battery compartment 154*a*, and the starboard battery bank 120*b* during an initial installation step (i.e., Step 1). The following description refers generally to installation of the starboard battery bank 120*b* however the described steps equally apply for installation of the port battery bank 120*b*.

Generally, the port and starboard battery banks 120*a*, 120*b* are each installed into the respective battery compartments 154*a*, 154*b* using a pulley system 200 for hoisting, lowering and rotating each of the port and starboard battery banks 120*a*, 120*b*. The configuration of the pulley system 200 can vary from what is shown. In the illustrated example, the pulley system 200 has a hoist 202 having ring ends 203 which are temporarily clipped to opposing mounting flanges 204 extending from one side of the battery bank 120*b*. The opposite side of the battery bank 120*b* has a hang bracket 210, which facilitates lateral sliding of the battery bank 120*b* into the battery compartment 154*b*, as further described herein below. The hang bracket 210 protrudes upwardly from the top of the battery bank 120*b*. The pulley system 200 further includes port and starboard pulley wires 214*a*, 214*b* which extend through port and starboard pulley wheels 216*a*, 216*b* coupled to the hull 22 on opposite sides of the hatch 158. The port pulley wire 214*a* has ends which are temporarily coupled to the ring ends 203 on the opposing mounting flanges 204 and the starboard pulley wire 214*b* has an end which is temporarily coupled to the portion of the side bracket 210 protruding upwardly from the top 212 of the battery bank 120*b*.

According to step 1 of the installation method (see FIG. 14), the battery bank 120*b* is lowered into the hatch 158 in an orientation wherein the height H of the battery bank 120 is extending in the lateral direction LA, with the hang bracket 210 on the bottom. As shown, the port pulley wire 214*a* is affixed to the ring ends 203. The starboard pulley wire 214*b* extends downwardly through the starboard deck 150*b* and is affixed to the hang bracket 210.

According to step 2 (FIG. 15), the port pulley wire 214*a* is retracted while the starboard pulley wire 214*b* is slowly loosened, as shown by the arrows, so as to tilt the battery bank 120*b* is tilted into the angular position shown wherein the edge of the hang bracket 210 abuts laterally extending slide bars 220 on the base plates 124*b*.

Figure 6:
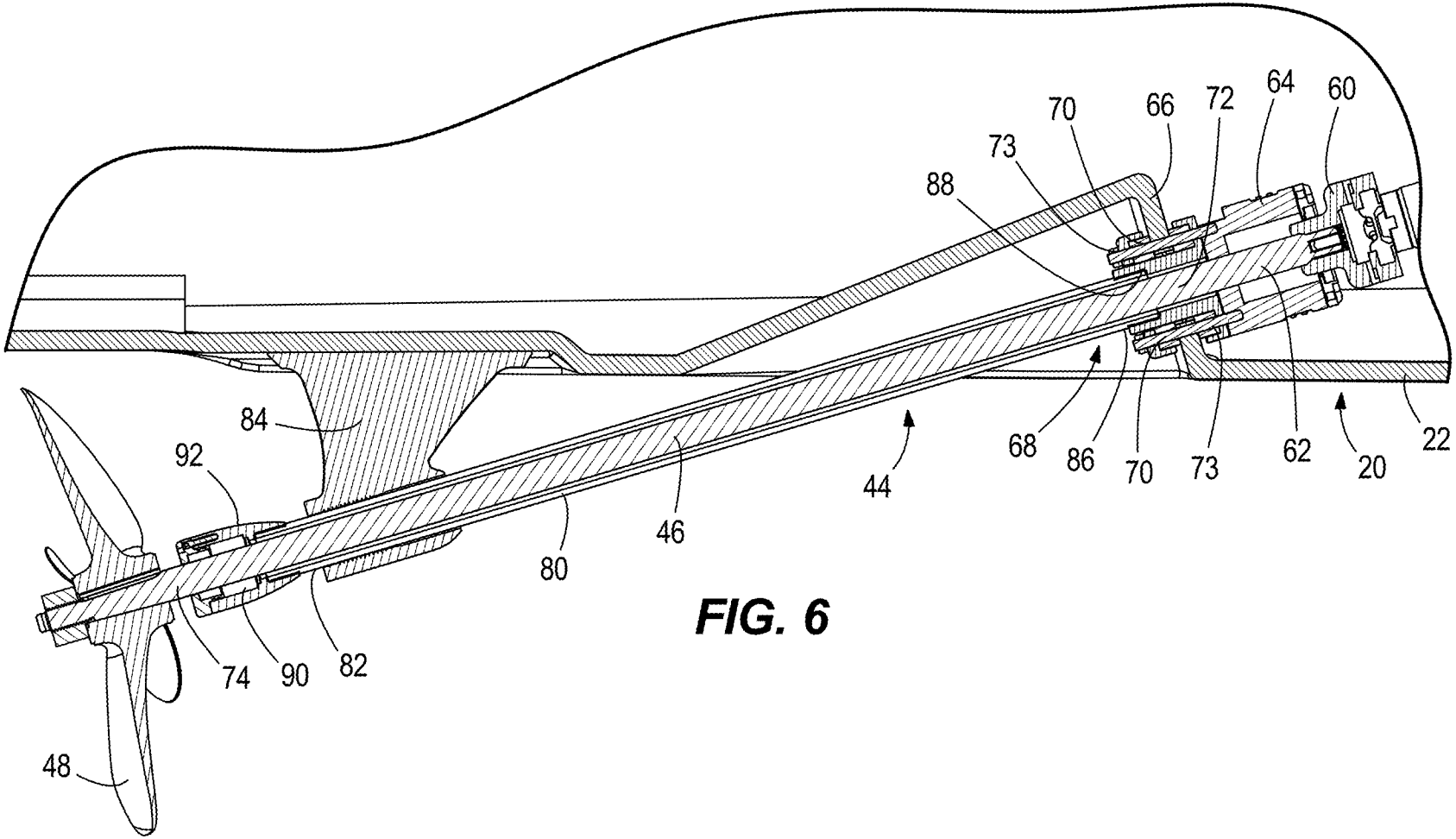
FIG. 6 is a sectional view of the driveshaft assembly.

According to steps 3-6 (FIGS. 16-19), the starboard pulley wire 214*b* is slowly retracted while the port pulley wire 214*a* is slowly loosened, as shown by arrows, which continues to tilt the battery bank 120*b*, clockwise in the figures, as the battery bank 120*b* is safely slid along the slide bars 220 into the position shown in FIG. 6.

According to step 7 (FIG. 20), the hang bracket 210 is removed and re-attached to the opposite end of the battery bank 120*b*, as shown. The starboard pulley wire 214*b* is then slowly retracted while the port pulley wire 214*a* is loosened, which further slides the battery bank 120*b* into the battery compartment 154*b*

According to step 8 (FIG. 21), the starboard pulley wire 214*a* is further loosened, which safely lowers the battery bank 120*b* onto the base plate 124*b*. This completes the installation and the pulley assembly 200 is removed from the marine vessel 20.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A marine vessel comprising:

a hull extending from a stern to a bow in a longitudinal direction, from a port side to a starboard side in a lateral direction which is perpendicular to the longitudinal direction, and from a top to a bottom in an axial direction which is perpendicular to the longitudinal direction and perpendicular to the axial direction;

an electric motor and a propulsor, wherein the electric motor is configured to operate the propulsor for generating a propulsive force for propelling the marine vessel in water, port and starboard rear ballast cavities configured to take on ballast water for modifying a wake produced by the marine vessel in the water; and port and starboard battery banks which provide battery power to the electric motor, wherein the port and starboard battery banks are located longitudinally closer to the stern than the bow and over the port and starboard rear ballast cavities in the axial direction, respectively.

2. The marine vessel according to claim 1, further comprising a driveshaft, wherein the electric motor causes rotation of the driveshaft for the propulsor, and wherein the driveshaft is located laterally between and axially below the port and starboard batteries.

3. The marine vessel according to claim 1, wherein the port and starboard rear ballast cavities are at least partially defined by fiberglass sidewalls.

4. The marine vessel according to claim 1, further comprising port and starboard base plates located axially on top of the port and starboard rear ballast cavities, wherein the port and starboard base plates comprise foam configured to reduce noise, vibration and harshness.

5. A marine vessel comprising:

a hull extending from a stern to a bow in a longitudinal direction, from a port side to a starboard side in a lateral direction which is perpendicular to the longitudinal direction, and from a top to a bottom in an axial direction which is perpendicular to the longitudinal direction and perpendicular to the axial direction;

an electric motor and a propulsor, wherein the electric motor is configured to operate the propulsor for generating a propulsive force for propelling the marine vessel in water;

port and starboard rear ballast cavities configured to take on ballast water for modifying a wake produced by the marine vessel in the water; and port and starboard battery banks which provide battery power to the electric motor, wherein the port and starboard battery banks are located axially above the port and starboard rear ballast cavities, respectively, wherein the marine vessel has a center of buoyancy and wherein the port and starboard battery banks are located longitudinally between the stern and the center of buoyancy.

6. The marine vessel according to claim 1, wherein the port and starboard rear ballast cavities are longitudinally closer to the stern than the bow.

7. The marine vessel according to claim 6, further comprising a front ballast cavity located longitudinally closer to the bow than the stern, the front ballast cavity being configured to take on ballast water for modifying a wake produced by the marine vessel in the water.

8. The marine vessel according to claim 1, further comprising a power distribution unit configured to control supply of the battery power to and from the port and starboard battery banks, the power distribution unit being located laterally between the port and starboard battery banks.

9. The marine vessel according to claim 8, further comprising a hatch located laterally between the port and starboard battery banks, wherein the hatch contains the power distribution unit.

10. The marine vessel according to claim 9, further comprising an access lid on the hatch, the access lid being movable into and between a closed position enclosing the power distribution unit and an open position providing access to the power distribution unit.

11. The marine vessel according to claim 10, further comprising a gas spring assist device for assisting movement of the access lid.

12. The marine vessel according to claim 10, further comprising the power distribution unit configured to control a supply of the battery power to and from the port and starboard battery banks, the power distribution unit being located in the hatch.

13. The marine vessel according to claim 12, further comprising a supporting frame which supports the power distribution unit, the supporting frame located axially beneath the power distribution unit and laterally between the port and starboard battery banks.

14. The marine vessel according to claim 13, further comprising at least one vibration dampening isolator which supports the power distribution unit relative to the supporting frame, reducing noise, vibration and harshness.

15. The marine vessel according to claim 13, wherein the supporting frame is configured to prevent laterally inward movement of the port and starboard battery banks, respectively.

16. A marine vessel comprising:

a hull extending from a stern to a bow in a longitudinal direction, from a port side to a starboard side in a lateral direction which is perpendicular to the longitudinal direction, and from a top to a bottom in an axial direction which is perpendicular to the longitudinal direction and perpendicular to the axial direction;

an electric motor configured to operate a propulsor for generating a propulsive force for propelling the marine vessel in water;

port and starboard rear ballast cavities configured to take on ballast water for modifying a wake produced by the marine vessel in the water;

port and starboard battery banks for providing battery power to the electric motor, wherein the port and starboard battery banks are located over the port and starboard rear ballast cavities in the axial direction, respectively, and are spaced apart from each other such that a hatch is defined therebetween; and port and starboard decks located over the port and starboard rear ballast cavities in the axial direction such that port and starboard battery compartments are located axially between the port and starboard decks and the port and starboard ballast cavities, with the hatch therebetween, wherein the port and starboard battery banks, when installed in the port and starboard battery compartments have a length, a width and a height, and wherein the height is less than a width of the hatch in the lateral direction and the length and width is greater than the width of the hatch in the lateral direction such that the port and starboard battery banks are rotated when in port and starboard battery compartments relative to before entering the hatch.

17. A method of installing a battery bank into a marine vessel having a hull extending from a stern to a bow in a longitudinal direction, from a port side to a starboard side in a lateral direction which is perpendicular to the longitudinal direction, and from a top to a bottom in an axial direction which is perpendicular to the longitudinal direction and perpendicular to the axial direction, the marine vessel also having port and starboard rear ballast cavities configured to take on ballast water for modifying a wake produced by the marine vessel in the water, the method comprising:

lowering a battery bank into a hatch, in an orientation in which a height of the battery bank extends in the lateral direction; and rotating the battery banks until the height extends in the axial direction while simultaneously laterally sliding the battery bank into a position axially over one of the port and starboard rear ballast cavities.

18. The method according to claim 17, further comprising adding a hang bracket on one side of the battery banks to assist said laterally sliding.

* * * * *